US005798204A

United States Patent [19]

Fukui et al.

[11] Patent Number: 5,798,204

[45] Date of Patent: Aug. 25, 1998

[54] DEVELOPMENT PROCESSING METHOD OF ULTRAHIGH-CONTRAST BLACK-AND-WHITE SILVER HALIDE PHOTOGRAPHIC MATERIAL

[75] Inventors: Kouta Fukui; Mitsunori Hirano; Nobuaki Inoue, all of Kanagawa, Japan

[73] Assignee: Fuji Photo Film Co., Ltd., Kanagawa, Japan

[21] Appl. No.: 766,934

[22] Filed: Dec. 16, 1996

Related U.S. Application Data

[63] Continuation of Ser. No. 507,556, Jul. 26, 1995, abandoned.

[30] Foreign Application Priority Data

| | | | |
|---|---|---|---|
| Jul. 26, 1994 | [JP] | Japan | 6-174033 |
| Jul. 26, 1994 | [JP] | Japan | 6-192758 |
| Aug. 24, 1994 | [JP] | Japan | 6-199328 |

[51] Int. Cl.[6] ..... G03C 5/18; G03C 5/26; G03C 1/06; G03C 1/00

[52] U.S. Cl. ..... 430/399; 430/264; 430/438; 430/439; 430/465; 430/481; 430/482; 430/492; 430/598

[58] Field of Search ..... 430/264, 399, 430/438, 439, 465, 481, 482, 492, 598

[56] References Cited

U.S. PATENT DOCUMENTS

| | | | |
|---|---|---|---|
| 2,688,548 | 9/1954 | Reynolds | 430/465 |
| 2,688,549 | 9/1954 | James et al. | 430/465 |
| 2,784,086 | 3/1957 | Henn | 430/482 |
| 2,879,160 | 3/1959 | Hunsberger | 430/482 |
| 2,887,377 | 5/1959 | Dickenson | 430/482 |
| 3,275,440 | 9/1966 | Kempe et al. | 430/439 |
| 3,658,527 | 4/1972 | Kunz et al. | 430/481 |
| 4,046,571 | 9/1977 | Mertz | 430/438 |
| 5,204,230 | 4/1993 | Hayashi | 430/465 |
| 5,236,816 | 8/1993 | Purol et al. | 430/492 |
| 5,264,323 | 11/1993 | Purol et al. | 430/492 |
| 5,272,045 | 12/1993 | Patel et al. | 430/465 |
| 5,288,590 | 2/1994 | Kuwabara et al. | 430/439 |
| 5,382,496 | 1/1995 | Sakai et al. | 430/264 |
| 5,464,730 | 11/1995 | Okutsu et al. | 430/399 |
| 5,545,508 | 8/1996 | Marchesano et al. | 430/482 |
| 5,652,086 | 7/1997 | Brayer et al. | 430/399 |
| 5,691,108 | 11/1997 | Hirano et al. | 430/465 |

FOREIGN PATENT DOCUMENTS

| | | | |
|---|---|---|---|
| 484293 | 6/1992 | Canada | 430/492 |
| 0 518 541 A1 | 6/1992 | European Pat. Off. . | |
| 0585792 | 3/1994 | European Pat. Off. | 430/399 |
| 4120867 | 1/1993 | Germany | 430/399 |
| 6-35133 | 2/1994 | Japan | 430/465 |

*Primary Examiner*—Mark L. Bell
*Assistant Examiner*—J. Pasterczyk
*Attorney, Agent, or Firm*—Sughrue, Mion, Zinn, Macpeak & Seas, PLLC

[57] ABSTRACT

A development processing method is described, which includes the steps of (a) exposing an ultrahigh-contrast silver halide photographic material comprising a support having thereon at least one light-sensitive silver halide emulsion layer and (b) developing the exposed silver halide photographic material with a developer while the developer is replenished with a development replenisher, wherein the developer and the development replenisher each contains a dihydroxybenzene developing agent and an auxiliary developing agent exhibiting a superadditive property to the dihydroxybenzene developing agent, and both the developer and the development replenisher have such a property that an increase of the pH is 0.25 or less when 0.1 mol of sodium hydroxide is added to 1 liter thereof; the developer has a pH from 9.5 up to but excluding 11.0; and the developer replenisher is added in an amount of 225 ml/m$^2$ or less.

13 Claims, No Drawings

DEVELOPMENT PROCESSING METHOD OF ULTRAHIGH-CONTRAST BLACK-AND-WHITE SILVER HALIDE PHOTOGRAPHIC MATERIAL

This is a Continuation of Application Ser. No. 08/507,556 filed Jul. 26, 1995, now abandoned.

FIELD OF THE INVENTION

The present invention relates to a development processing method for forming an ultrahigh contrast image using a silver halide photographic material having a pH of less than 11. Particularly, the present invention relates to a development processing method in which the amount of developer replenishment is small.

Furthermore, the present invention relates to an ultrahigh contrast silver halide photographic material for photomechanical processing.

Moreover, the present invention relates to an ultrahigh contrast negative image formation method using a silver halide photographic material. More particularly, the present invention relates to an ultrahigh contrast negative photographic material suitable for a light-sensitive material in daylight.

BACKGROUND OF THE INVENTION

In the field of graphic arts, an image formation system providing ultrahigh contrast (especially a γ of 10 or more) is required for enabling reproduction of a continuous gradation image through a half-tone image or reproduction of a line original image.

As a process for obtaining a high contrast image, a lith developing method utilizing what is called an "infectious development effect" has been used for a long time, but the method is not preferred because the developer is unstable.

It has been known from U.S. Pat. No. 3,730,727 (a developer combination of ascorbic acid with hydrazine), U.S. Pat. No. 3,227,552 (using hydrazine as an auxiliary developing agent for directly obtaining positive color image), U.S. Pat. No. 3,386,831 (containing β-monophenylhydrazide of aliphatic carboxylic acid as a stabilizer for a silver halide light-sensitive material), U.S. Pat. No. 2,419,975, and Mees, *The Theory of the Photographic Process*, 3rd edition, 1966, p. 281 that a hydrazine compound is added to a silver halide emulsion or a developer.

Above all, U.S. Pat. No. 2,419,975 discloses that the addition of a hydrazine compound gives a negative image having a higher contrast.

U.S. Pat. No. 2,419,975 also discloses that when a hydrazine compound is added to a silver chlorobromide emulsion and a photographic material is developed with a developer having a pH as high as 12.8, an ultrahigh contrast having a gamma (γ) value exceeding 10 can be obtained. However, a strongly alkaline developer having a pH near 13 is easily air-oxidized and is very unstable so that it is not suitable for long term storage and use.

An image formation system which develops a material with a processing solution having good storage stability to obtain an ultrahigh contrast image has been desired. For example, as described in U.S. Pat. Nos. 4,166,742, 4,168,977, 4,221,857, 4,224,401, 4,243,739, 4,272,606, and 4,311,781, there is a system for forming an ultrahigh contrast negative image having a γ value exceeding 10 by processing a surface latent image type silver halide photographic material containing a specific acyl hydrazine compound with a developer containing 0.15 mol/l of a sulfite preservative and having a pH of 11.0 to 12.3. While only a silver halide having a high silver chloride content can be used for the conventional ultrahigh contrast image formation system, this novel image formation system has a property that silver iodobromide and silver chloroiodobromide may also be used. Moreover, whereas only a very trace amount of a sulfite preservative can be used in the conventional lith developer, the developer disclosed therein can contain a large amount of a sulfite preservative so that the system has relatively good storage stability. However, the developer having a pH of 11 or more is easily air-oxidized and, thus, it is unstable and not suitable for long-term storage and use.

As a method to obtain a high contrast photographic property by using a stable developer, methods using hydrazine derivatives are known as described in U.S. Pat. Nos. 4,224,401, 4,168,977, 4,166,742, 4,311,781, 4,272,606, 4,221,857, 4,332,878, 4,634,661, 4,618,574, 4,269,922, 4,650,746 and 4,681,836. In these methods, because ultrahigh contrast and high-sensitive photographic properties are provided and nitrites can be added to a developer in a high concentration, the stability of the developer for air oxidation is remarkably improved as compared with the lith developer.

The photographic material for daylight used in assembly processing or dot-to-dot working processing is a photographic material which is utilized for negative image/positive image conversion or positive image/positive image conversion by using a developed film on which letters or half-tone images are formed, and contact-exposing such a text with a photographic material for dot-to-dot working. This material is desired:

(1) to have a property that the half-tone image, the line original and the letter image are subjected to negative image/positive image conversion according to the area of the half-tone, the width of the line and the width of the letter image, respectively, and (2) to have a property of adjusting the tone of the half-tone image and adjusting the line width of the letter line original. Thus, to satisfy the above-described demands, photosensitive materials for daylight have been provided.

However, in superimposed letter image formation by overlay contact working, the conventional daylight dot-to-dot working process using a photosensitive material for daylight is disadvantageous in that the quality of the superimposed letter images is deteriorated in comparison with those produced by the conventional daylight dot-to-dot working process using a dot-to-dot working photographic material for daylight.

The processes for forming a superimposed letter image by overlay contact working and the problems thereof are described in JP-A-4-265970 (the term "JP-A" used herein means an unexamined Japanese patent application) in detail. As shown in FIG. 1 of JP-A-4-265970, transparent or translucent pasting bases (a) and (c) (usually polyethylene terephthalate films having a thickness of approximately 100 μm are used) are each placed on a laminate in which film (b) having a letter or line original image formed thereon (line original text) and film (d) having a half-tone image formed thereon (halftone original text) are pasted to make texts, which is exposed by bringing the half tone text (d) in contact with an emulsion face of a photographic material for dot-to-dot working (e).

After the exposure, the texts a re developed to form white spots of the line original in the halftone image.

It is important for the process for forming such a superimposed letter image that the negative image/positive image conversion is ideally carried out according to the area of the halftone of the halftone text and line width of the line original text. However, as is clear from FIG. 1 of JP-A-4-265970, while the halftone text is directly in contact with the emulsion face of the photographic material for dot-to-dot working to be exposed, the line original text is exposed with a photographic material for dot-to-dot working via intermediate pasting base (c) and halftone text (d).

For this reason, when the halftone text is exposed in an amount for a negative image/positive image conversion, since the line original text becomes out of focus interposing a spacer due to pasting base (c) and halftone text (d), the line image width of the white spots of the line original becomes narrow. As a result, the quality of the superimposed letter image is deteriorated.

Systems in order to solve the above problems using hydrazine are disclosed in JP-A-62-80640, JP-A-62-235938, JP-A-62-235939, JP-A-63-104046, JP-A-63-103235, JP-A-63-296031, JP-A-63-314541, and JP-A-64-13545. In these processes, the image quality can be drastically improved, but because of a high pH of the developer, the systems are markedly air-oxidized. Thus, it is necessary to use a large amount of hydroquinone and to maintain hydroquinone at a constant high level.

Attempts have been made to develop a silver halide photographic material containing a hydrazine compound having a low pH to produce a high contrast image.

JP-A-1-179939 and JP-A-1-179940 disclose a process for developing a photographic material containing a nucleating development accelerator having an absorbing group to a silver halide emulsion particle and a nucleating agent having an absorbing group with a developer having a pH of 11.0 or less. However, if the adsorbing group-containing compound is added to the silver halide emulsion in excess of a given critical amount, the sensitivity is impaired, the developing is suppressed, and the functions of other available absorbing additives are prevented. Therefore, the amount of the compound used is restricted and, thus, no sufficient high contrast can be expressed. Moreover, since the emulsion used therein which is silver bromide or silver chlorobromide, has poor characteristics and large variation of photographic properties according to the variation of the composition of the developer, the stability thereof is not sufficient.

JP-A-60-140340 discloses that contrast can be increased by adding amines to a silver halide photographic material. However, if the material is developed with a developer having a pH of less than 11.0, sufficient contrast cannot be provided.

JP-A-56-106244 discloses the addition of an amino compound into a developer having a pH of from 10 to 12 so as to increase the contrast. However, in using a developer having an amine compound added thereto, there are problems of smell of the liquid, stain of the application apparatus due to the adsorption, and environmental pollution due to the waste liquid. Although the amine compound is desired to be incorporated in a photosensitive material, no compound which can give sufficient properties when added to the photographic material has yet been found.

U.S. Pat. Nos. 4,998,604, 4,994,365 and 4,975,354 disclose hydrazine compounds having an ethylene oxide repeating unit and hydrazine compounds having a pyridinium group. However, as is clear from the working examples of these patents, the contrast is insufficient, and it is difficult to obtain a sufficient contrast and a required Dmax value under practical conditions.

Various studies have been made to obtain an ultrahigh contrast image using a developer having a pH of less than 11.0; it has been found that the use of a hydrazine nucleating agent in combination with a quaternary onium salt nucleating accelerator gives an ultrahigh contrast image. However, in this process, it is required for processing 1 square meter of silver halide photographic material to replenish 320 to 450 ml of the developer also. Thus, it has been desired to develop a process for reducing the amount of developer to be replenished and a safety processing method. If an amount of the developer to be replenished is reduced, through there arises a problem that a silver sludge in the developing tank is increased and is adsorbed onto the photographic material.

Examples of the use of chemically sensitized silver chlorobromide in a system using hydrazine derivatives are described in JP-A-53-20921, JP-A-60-83028, JP-A-60-140399, JP-A-63-46437, JP-A-63-103230, JP-A-3-294844, JP-A-3-294845, JP-A-4-174424, and JP-A-6-19035. On the other hand, examples in which a silver halide emulsion containing hydrazine derivatives and a heavy metal complex such as rhodium and iridium are used in combination are disclosed in JP-A-60-83028, JP-A-61-47942, JP-A-61-47943, JP-A-61-29837, JP-A-62-201233, JP-A-62-235947 and JP-A-63-103232.

It has been known that the change of photographic properties is reduced by reducing the change of the pH of the developer. It is disclosed in JP-B-3-5730 (the term "JP-B" used herein means an examined Japanese patent publication) that the photographic properties are increased by increasing the buffering properties of the developer.

It has been known that the developer can be provided as a solid processing agent, and JP-A-61-259921 discloses the enhancement of the stabilization of the developer as a solid processing agent. Furthermore, JP-A-5-265147 discloses a processing method in which a developer for processing a hydrazine-containing photographic material is provided as a solid processing agent to improve black spots.

SUMMARY OF THE INVENTION

An object of the present invention is, therefore, to provide a development processing method of a silver halide black-and-white photographic material, which gives an image having a sufficient high contrast, has less variation of photographic properties even when a small amount of the developer is replenished, and always provides stable properties.

Another object of the present invention is to provide a development processing method of a photographic material for daylight which can give a good superimposed letter image with a stable developer having a pH of less than 11.0, has a less variation of the properties even when a small amount of the developer is replenished, and can always give stable properties.

Furthermore, an object of the present invention is to provide a development processing method having a little silver staining even when a small amount of the developer is replenished.

These and other objects of the present invention have been attained by a development processing method, which comprises the steps of (a) exposing a silver halide photographic material comprising a support having thereon at least one light-sensitive silver halide emulsion layer and (b) developing the exposed silver halide photographic material with a developer while the developer is replenished with a developer replenisher, wherein the developer and the developer replenisher each contains a dihydroxybenzene developing agent and an auxiliary developing agent exhibiting a superadditive property to the dihydroxybenzene developing agent, and has such a property that an increase of the pH of the developer is 0.25 or less when 0.1 mol of sodium hydroxide is added to 1 liter thereof; the developer has a pH of from 9.5 to less than 11.0; and the developer replenisher is added in an amount of 225 ml/m$^2$ or less.

DETAILED DESCRIPTION OF THE INVENTION

In the first preferable embodiment of the above-described development processing method according to the present invention, the silver halide emulsion layer or other hydrophilic colloid layer contains at least one hydrazine derivative represented by the following formula (I):

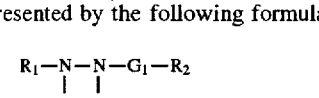

$$R_1-\underset{A_1}{N}-\underset{A_2}{N}-G_1-R_2 \quad (I)$$

wherein $R_1$ represents an aliphatic group or an aromatic group; $R_2$ represents a hydrogen atom, an alkyl group, an aryl group, an unsaturated heterocyclic group, an alkoxy group, an aryloxy group, an amino group or a hydrazino group; $G_1$ represents —CO—, —$SO_2$—, —SO—, —PO($R_3$)—, —CO—CO—, a thiocarbonyl group or an iminomethylene group, in which $R_3$ has the same meaning as $R_2$, but it may be different from $R_2$; $A_1$ and $A_2$ are both a hydrogen atom, or one of them is a hydrogen atom and the other is a substituted or unsubstituted alkylsulfonyl group, a substituted or unsubstituted arylsulfonyl group or a substituted or unsubstituted acyl group. In this embodiment, the silver halide photographic material may be a silver halide black-and-white photographic material.

In the second embodiment of the above-described development processing method according to the present invention, the silver halide emulsion layer or other hydrophilic colloid layer contains at least one hydrazine derivative represented by the above-described formula (I), and the silver halide emulsion has a silver chloride content of 50 mol % or more and contains at least one complex selected from a rhodium complex, a ruthenium complex, a rhenium complex and an osmium complex in an amount of from $1\times10^{-8}$ to $1\times10^{-6}$ per mol of silver.

In the third embodiment of the above-described development processing method according to the present invention, the silver halide emulsion has an average particle size of less than 0.2 μm and a silver chloride content of 90 mol % or more. The silver halide emulsion layer or other hydrophilic colloid layer may contain at least one hydrazine derivative represented by the above-described formula (I).

In formula (I), the aliphatic group represented by $R_1$ is preferably an aliphatic group having from 1 to 30 carbon atoms, more preferably a straight-chain, branched or cyclic alkyl group having from 1 to 20 carbon atoms. The branched alkyl group may be cyclized to form a saturated heterocyclic ring containing one or more hetero atoms in the alkyl group. The alkyl group may be substituted with one or more substituents.

The aromatic group represented by $R_1$ in formula (I) includes a monocyclic or dicyclic aryl or unsaturated heterocyclic group. The unsaturated heterocyclic group represented by $R_1$ may form a heteroaryl group by fusing a monocyclic or dicyclic aryl group. Examples of the ring formed by $R_1$ include a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring. Among these, preferred is a benzene ring.

$R_1$ is more preferably an aryl group.

The aliphatic or aromatic group represented by $R_1$ may be substituted with one or more substituents. Examples of the substituents include an alkyl group, an alkenyl group, an alkynyl group, an aryl group, a heterocyclic group, a pyridinium group, a hydroxyl group, an alkoxy group, an aryloxy group, an acyloxy group, an alkylsulfonyloxy group, an arylsulfonyloxy group, an amino group, a carbonamido group, a sulfonamido group, a ureido group, a thioureido group, a semicarbazido group, a thiosemicarbazido group, a urethane group, a group having a hydrazide structure, a group having a quaternary ammonium structure, an alkylthio group, an arylthio group, an alkylsulfonyl group, an arylsulfonyl group, an alkylsulfinyl group, an arylsulfinyl group, a carboxyl group, a sulfo group, an acyl group, an alkoxycarbonyl group, an aryloxycarbonyl group, a carbamoyl group, a sulfamoyl group, a halogen atom, a cyano group, a phosphonamido group, a diacylamino group, an imido group, a group having an acylurea structure, a group containing a selenium atom or a tellurium atom, and a group having a tertiary sulfonium structure or a quaternary sulfonium structure. Of these, preferred are a strain-chain, branched or cyclic alkyl group (preferably alkyl group having from 1 to 20 carbon atoms), an aralkyl group (preferably monocyclic or dicyclic aralkyl group containing an alkyl moiety having from 1 to 3 carbon atoms), an alkoxy group (preferably alkoxy group having from 1 to 20 carbon atoms), a substituted amino group (preferably an amino group substituted with at least one alkyl group having from 1 to 20 carbon atoms), an acylamino group (preferably acylamino group having from 2 to 30 carbon atoms), a sulfonamido group (preferably sulfonamido group having from 1 to 30 carbon atoms), a ureido group (preferably ureido group having from 1 to 30 carbon atoms) and a phosphonamido group (preferably phosphonamido group having from 1 to 30 carbon atoms).

In formula (I), the alkyl group represented by $R_2$ is preferably an alkyl group having from 1 to 4 carbon atoms, and the aryl group represented by $R_2$ is preferably a monocyclic or dicyclic aryl group such as an aryl group containing a benzene ring.

The unsaturated heterocyclic group represented by $R_2$ is preferably a 5- or 6-membered ring containing at least one of nitrogen, oxygen and sulfur atoms. Examples thereof include an imidazolyl group, a pyrazolyl group, a triazolyl group, a tetrazolyl group, a pyridyl group, a pyridinium group, a quinolinium group and a quinolinyl group. Among these, more preferred are a pyridyl group and a pyridinium group.

The alkoxy group represented by $R_2$ is preferably an alkoxy group having from 1 to 8 carbon atoms. The aryloxy group represented by $R_2$ is preferably a monocyclic aryloxy group. The amino group represented by $R_2$ is preferably an unsubstituted amino group or an alkylamino or arylamino group having from 1 to 10 carbon atoms.

$R_2$ may be substituted with one or more substituents, and examples of the substituents include those recited above with respect to $R_1$.

When $G_1$ represents —CO—, $R_2$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl) or an aryl group (e.g., phenyl, 3,5-dichlorophenyl, o-methanesulfonamidophenyl, 4-methanesulfonylphenyl, 2-hydroxymethylphenyl), and more preferably a hydrogen atom or a trifluoromethyl group.

When $G_1$ represents —$SO_2$—, $R_2$ is preferably an alkyl group (e.g., methyl), an aralkyl group (e.g., o-hydroxybenzyl), an aryl group (e.g., phenyl) or a substituted amino group (e.g., dimethylamino).

When $G_1$ represents —CO—CO—, $R_2$ is preferably an alkoxy group, an aryloxy group or an amino group.

In formula (I), $G_1$ is preferably —CO— or —CO—CO—, and more preferably —CO—.

Further, $R_2$ may be a group such that it can split the $G_1$—$R_2$ moiety off the residual molecule and thereby cause the cyclization reaction to form a cyclic structure containing the atoms of the $G_1$—$R_2$ moiety. Specific examples of such a group include those disclosed in JP-A-63-29751.

$A_1$ and $A_2$ are each preferably a hydrogen atom, an alkylsulfonyl or arylsulfonyl group having from 1 to 20 carbon atoms (more preferably, a phenylsulfonyl group or a phenylsulfonyl group substituted with substituent(s) having a Hammett's reaction constant of −0.5 or more, such as a p-methylphenylsulfonyl group, a pentafluorophenylsulfonyl group, a p-ethoxycarbonylphenylsulfonyl group, a m-methoxyphenylsulfonyl group and a p-cyanophenylsulfonyl group) or an acyl group having from 1 to 20 carbon atoms (more preferably, a benzoyl group, a benzoyl group substituted with substituent(s) having a Hammett's reaction constant of −0.5 or more, such as a p-methylbenzoyl group, a pentafluorobenzoyl group, a p-ethoxycarbonylbenzoyl group, a m-methoxybenzoyl group and a p-cyanobenzoyl group, or a straight-chain, branched or cyclic acyl group, which may be substituted with substituent(s) such as a halogen atom, an ether group, a sulfonamido group, a carbonamido group, a hydroxyl group, a carboxyl group or a sulfonic acid group).

More preferably, $A_1$ and $A_2$ are each a hydrogen atom.

The substituents of $R_1$ and $R_2$ may be further substituted with one or more substituents, and examples of the substituents include those recited above with respect to $R_1$. The substituted substituents may be further substituted with a substituent, a substituted substituent, a ((substituted substituent)-substituted substituent, and so on, and the examples of the substituents also include those recited above with respect to $R_1$.

Moreover, $R_1$ or $R_2$ in formula (I) may be a group into which a ballast group used commonly in immobile photographic additives, such as couplers, or a polymer is introduced. The ballast group is a group containing 8 or more carbon atoms and having a relatively slight influence upon photographic properties, and examples thereof include an alkyl group, an aralkyl group, an alkoxy group, a phenyl group, an alkylphenyl group, a phenoxy group, and an alkylphenoxy group. Examples of the polymer include those described in JP-A-1-100530.

Furthermore, $R_1$ or $R_2$ in formula (I) may be a group into which a group capable of intensifying the adsorption onto the grain surface of silver halide is introduced. Examples of the adsorption-intensifying group include an alkylthio group, an arylthio group, a thiourea group, a heterocyclic thioamido group, a mercapto heterocyclic group and a triazole group, such as described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

The particularly preferred hydrazine derivative in the present invention is a hydrazine derivative represented by formula (I), wherein $R_1$ is a group capable of accelerating the adsorption onto a ballast group or a surface of silver halide grains through a sulfonamido group, an acylamino group or a ureido group, or a phenyl group containing a group having a quaternary ammonium structure or an alkylthio group; $G_1$ is —CO—; $R_2$ is a hydrogen atom or a substituted alkyl or substituted aryl group (the substituent thereof is preferably an electron attracting group or a hydroxymethyl group to the 2-position thereof). All the combinations of the above-described $R_1$ and $R_2$ can be selected and are preferred.

Specific examples of the compound represented by formula (I) are illustrated below. However, the invention should not be construed as being limited to these examples.

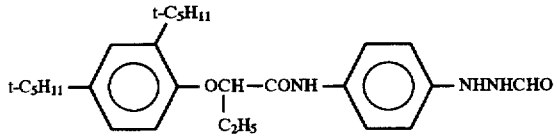

I-1

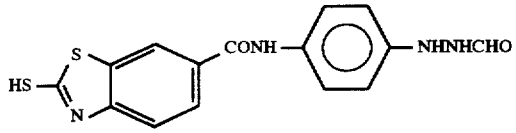

I-2

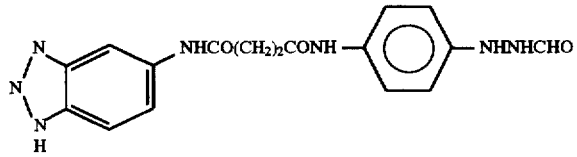

I-3

-continued
I-4
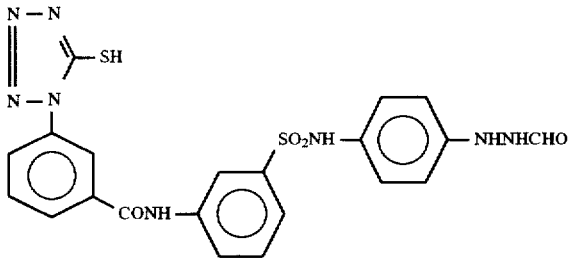
I-5
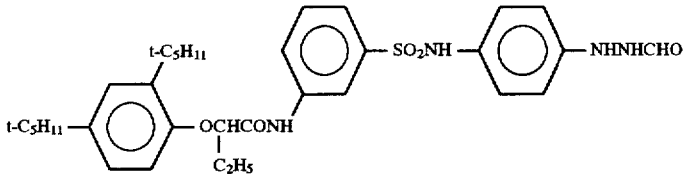
I-6
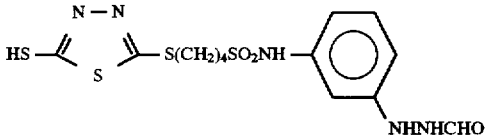
I-7
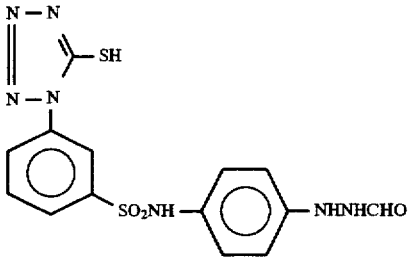
I-8
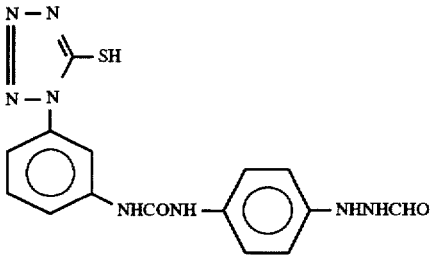
I-9
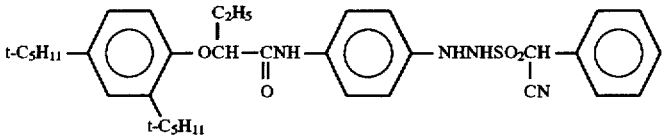
I-10
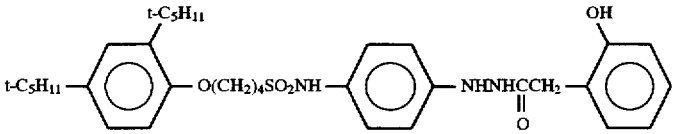
I-11
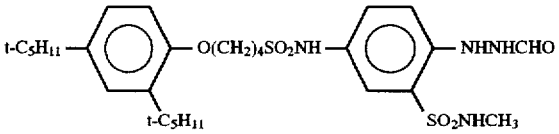

-continued
I-12
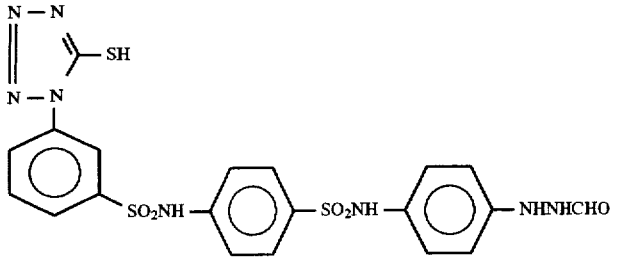
I-13
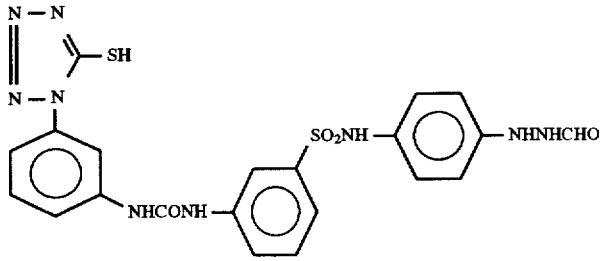
I-14
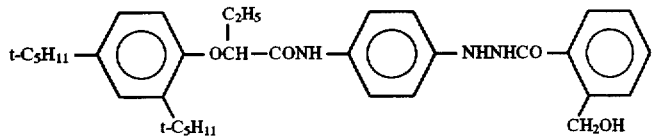
I-15
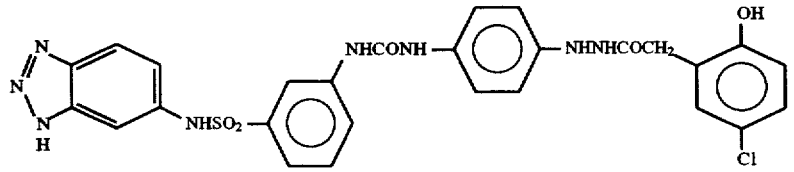
I-16
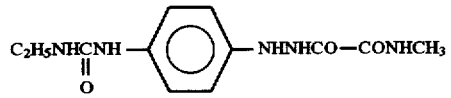
I-17
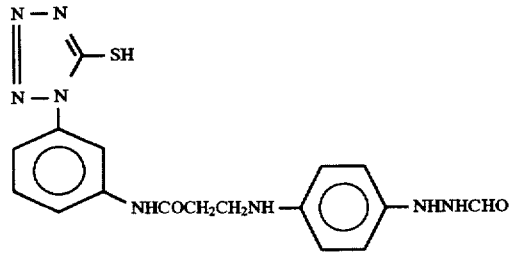
I-18
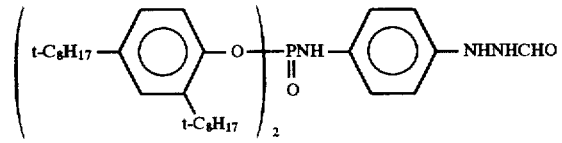
I-19
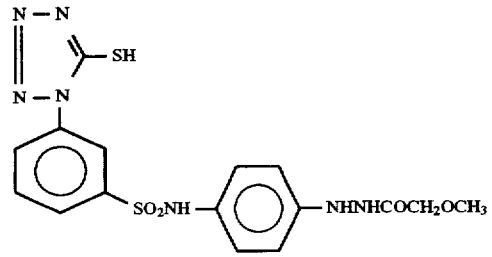

-continued
I-20
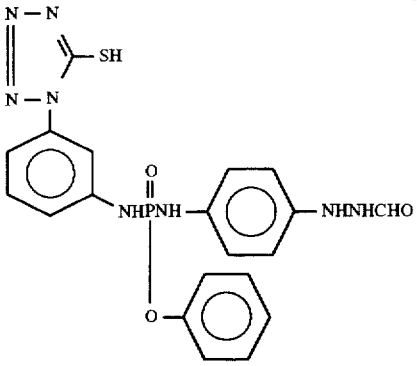
I-21
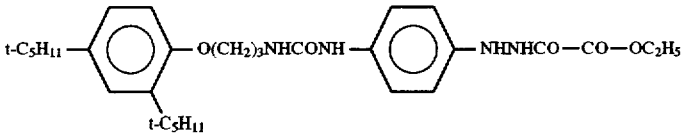
I-22
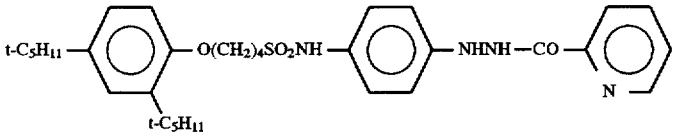
I-23
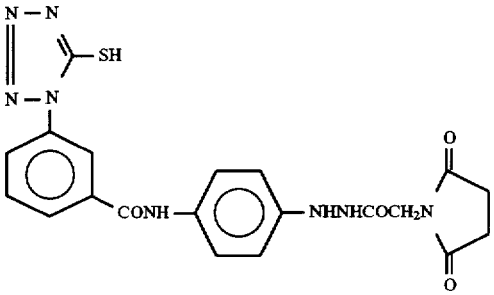
I-24
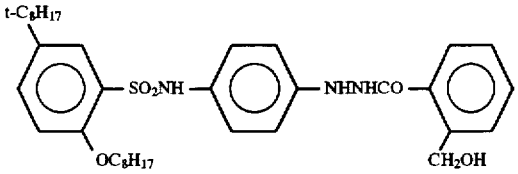
I-25
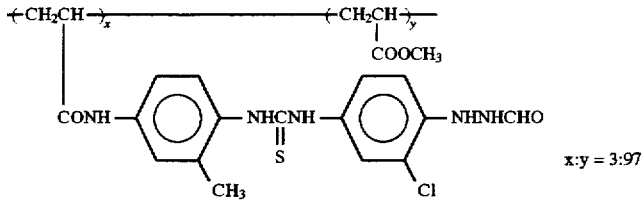
x:y = 3:97
Average molecular weight = about 100,000
I-26
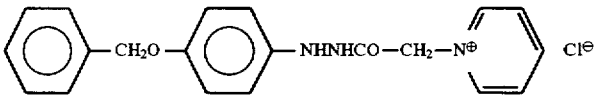
I-27
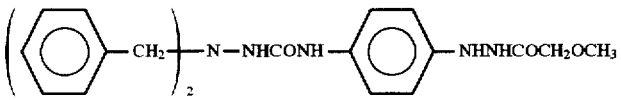

-continued
I-28
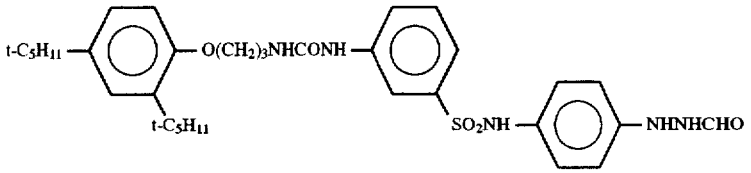
I-29
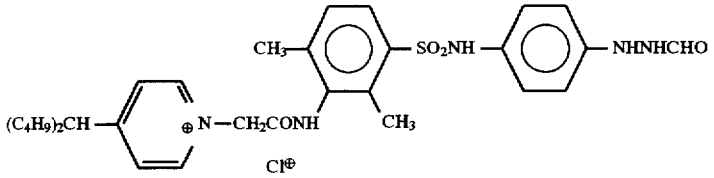
I-30
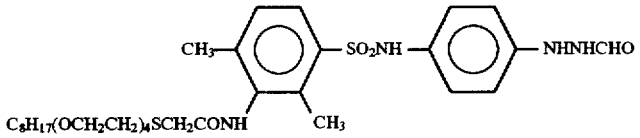
I-31
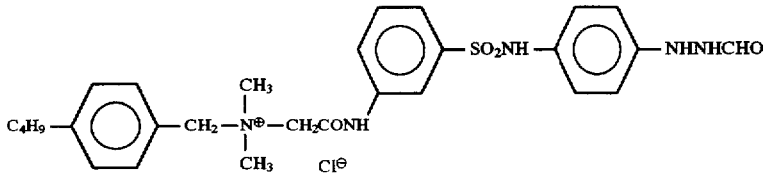
I-32
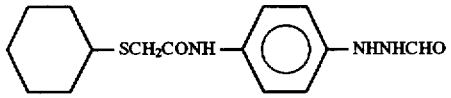
I-33
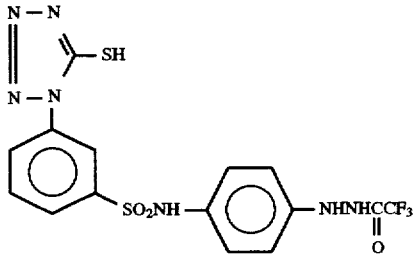
I-34
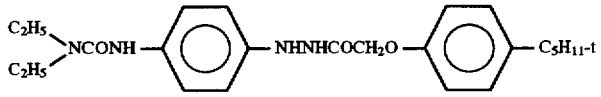
I-35
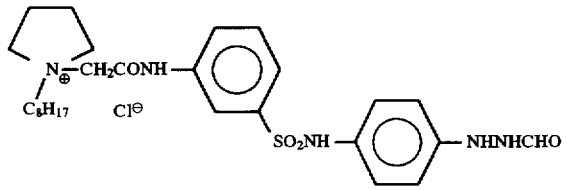
I-36
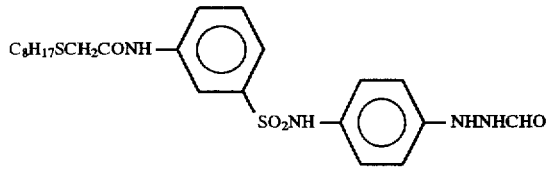

-continued
I-37
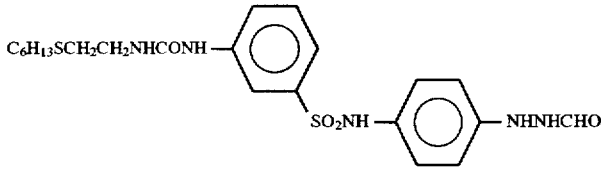
I-38
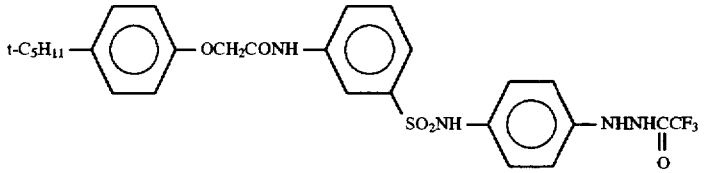
I-39
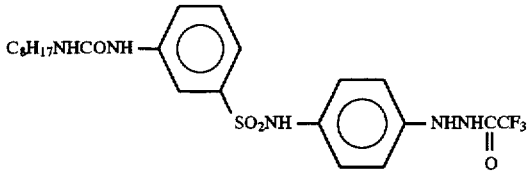
I-40
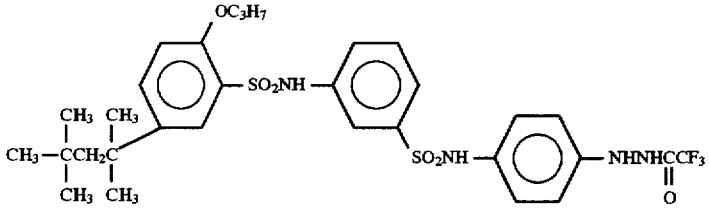
I-41
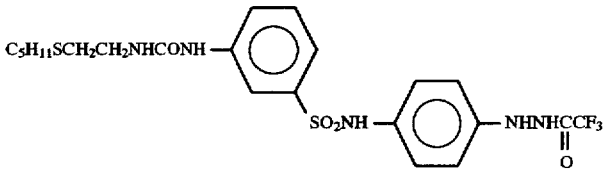
I-42
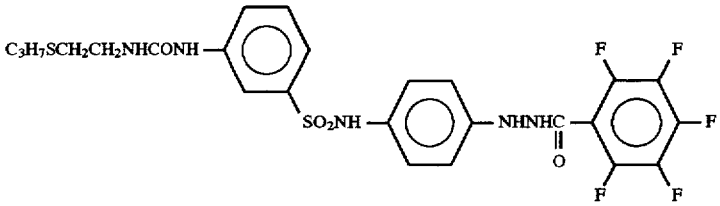
I-43
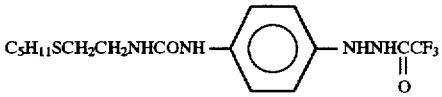
I-44
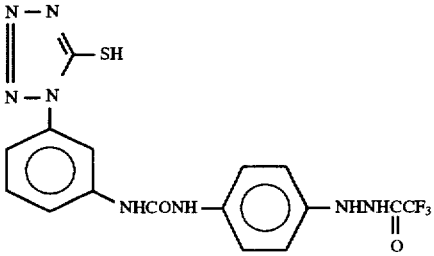

-continued
I-45
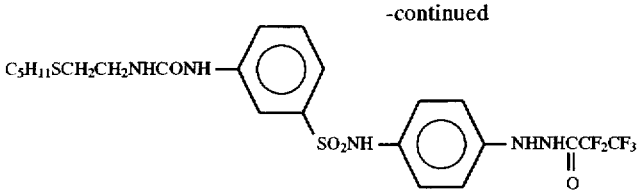
I-46
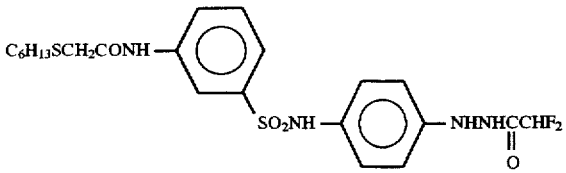
I-47
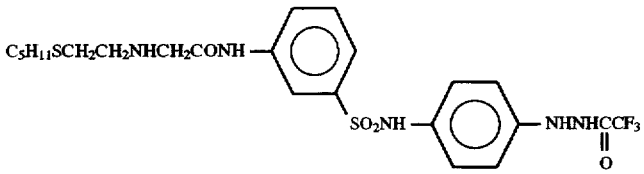
I-48
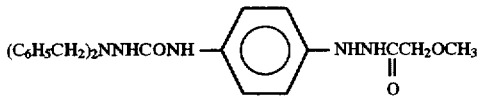
I-49
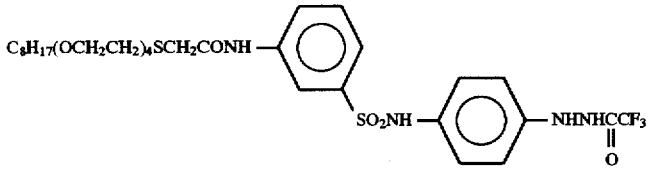
I-50
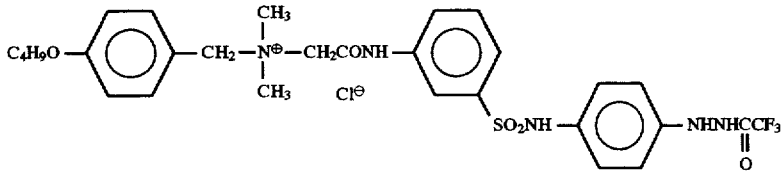
I-51
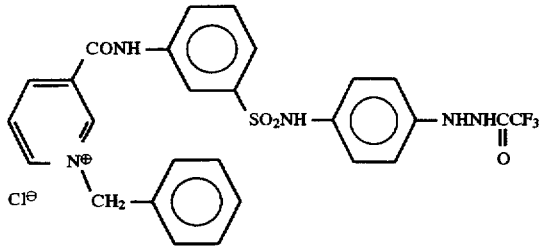
I-52
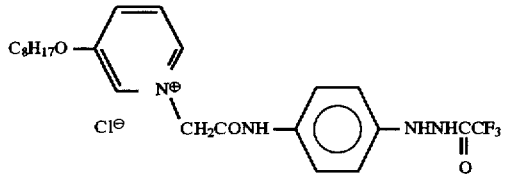
I-53
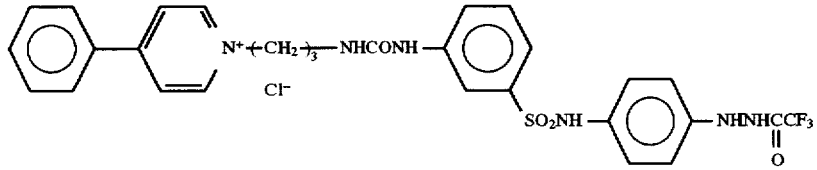

In addition to the above-illustrated ones, hydrazine derivatives which can be used in the present invention include those disclosed in *Research Disclosure*, Item 23516, page 346 (Nov., 1983), the references cited in ibid., U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355 and 5,104,769, British Patent No. 2,011,391B, European Patent Nos. 217,310, 301,799 and 356,898, JP-A-60-179734, JP-A-61-170733, JP-A-61-270744, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764 and JP-A-5-45765, and JP-A-6-289542.

The hydrazine derivative for use in the present invention is preferably added in an amount of from $1\times10^{-6}$ to $5\times10^{-2}$ mol, more preferably from $1\times10^{5}$ to $2\times10^{-2}$ mol, per mol of silver halide.

In using the hydrazine derivative in the present invention, it may be dissolved in a proper water-miscible organic solvent, such as alcohol (e.g., methanol, ethanol, propanol, fluorinated alcohol), ketone (e.g., acetone, methyl ethyl ketone), dimethylformamide, dimethylsulfoxide and methyl cellosolve.

Furthermore, the hydrazine derivative can be used in the form of emulsified dispersion, which is prepared using the well-known emulsion dispersion method in which the hydrazine derivative is dissolved using an oil such as dibutyl phthalate, tricresyl phosphate, glyceryl triacetate and diethyl phthalate, together with an auxiliary solvent, such as ethyl acetate and cyclohexanone, and then dispersed mechanically in an emulsified condition. On the other hand, the so-called solid dispersion method can be adopted in using the hydrazine derivative, wherein the powdered hydrazine derivative is dispersed into water by means of a ball mill, a colloid mill or ultrasonic waves.

The hydrazine derivative may be contained in fine polymer particles as described in JP-A-2-948.

In the development processing method of the present invention, at least one compound selected from compounds represented by formulae (II), (III), (IV) and (V) and an amino compound acting as a nucleating accelerator is preferably contained in the silver halide photographic material.

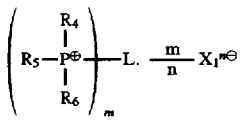

(II)

wherein $R_4$, $R_5$ and $R_6$ each independently represents an alkyl group, a cycloalkyl group, an aryl group, an alkenyl group, a cycloalkenyl group or a heterocyclic group, which each may be substituted; m represents an integer of from 1 to 4; L represents an m-valent organic group which bonds to the P atom in formula (II) via its carbon atom; n represents an integer of from 1 to 3; and $X_1$ represents an n-valent anion and $X_1$ may be connected to L;

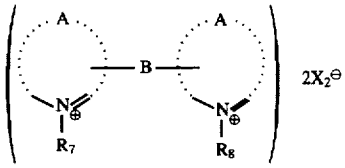

(III)

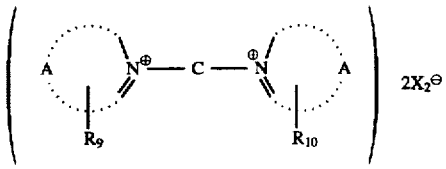

(IV)

wherein A represents an organic group necessary for forming a heterocyclic ring; B and C each independently represents a divalent group; $R_7$ and $R_8$ each independently represents an alkyl group or an aryl group, which each may be substituted; $R_9$ and $R_{10}$ each independently represents a hydrogen atom or a substituent; and $X_2$ represents an anion, with the proviso that, if an intermolecular salt is formed, $X_2$ does not exist;

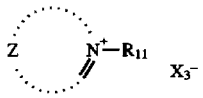

(V)

wherein Z represents an atomic group necessary for forming a nitrogen-containing heteroaromatic ring; $R_{11}$ represents an alkyl group; and $X_3^-$ represents a counter anion.

The nucleating accelerators represented by formulae (II) to (V) will be described below.

The compound represented by formula (II) will now be described in detail.

R4, $R_5$ and $R_6$ are the same or different and each represents an alkyl group, a cycloalkyl group, an aryl group, an alkenyl group, a cycloalkenyl group or a heterocyclic group, which each may be substituted with one or more substituents.

m represents an integer of from 1 to 4; L represents an m-valent organic group which bonds to the P atom in formula (II) via its carbon atom; n represents an integer of from 1 to 3; and $X_1$ represents an n-valent anion and may be connected to L.

Examples of the groups represented by $R_4$, $R_5$ and $R_6$ include a straight-chain or branched alkyl group (e.g., methyl, ethyl, propyl, isopropyl, butyl, isobutyl, sec-butyl, tert-butyl, octyl, 2-ethylhexyl, dodecyl, hexadecyl, octadecyl), an aralkyl group (e.g., substituted or unsubstituted benzyl), a cycloalkyl group (e.g., cyclopropyl, cyclopentyl, cyclohexyl), an aryl group (e.g., phenyl, naphthyl, phenantollyl), an alkenyl group (e.g., allyl, vinyl, 5-hexenyl), a cycloalkenyl group (e.g., cyclopentenyl, cyclohexenyl), and a heterocyclic group (e.g., pyridyl, quinolyl, furyl, imidazolyl, thiazolyl, thiadiazolyl, benzotriazolyl, benzothiazolyl, morpholyl, pyrimidyl, pyrrolidnyl). These substituents may be further substituted with one or more substituents, and examples thereof include, in addition to the groups represented by $R_4$, $R_5$ and $R_6$, a halogen atom (e.g., fluorine, chlorine, bromine, iodine), a nitro group, a primary, secondary or tertiary amino group, an alkylether group, an arylether group, an alkylthioether group, an arylthioether group, a carbonamido group, a carbamoyl group, a sulfonamido group, a sulfamoyl group, a hydroxyl group, a sulfoxy group, a sulfonyl group, a carboxyl group, a sulfonic acid group, a cyano group or a carbonyl group. Examples of the group represented by L include, in addition to the groups represented by $R_4$, $R_5$ and $R_6$, a polymethylene group (e.g., trimethylene, tetramethylene, hexamethylene, pentamethylene, octamethylene, dodecamethylene), a divalent aromatic group (e.g., phenylene, biphenylene, naphtylene), a polyvalent aliphatic group (e.g., trimethylenemethyl, tetramethylenemethyl), and a polyvalent aromatic group (e.g., phenylene-1,3,5-toluyl, phenylene-1,2,4,5-tetrayl).

Examples of the anion represented by $X_1$ include a halogen ion (e.g., chlorine ion, bromine ion, iodine ion), a carboxylate ion (e.g., acetate ion, oxalate ion, fumarate ion, benzoate ion), a sulfonate ion (e.g., p-toluene sulfonate ion, methane sulfonate ion, butane sulfonate ion, benzene sulfonate ion), a sulfuric acid ion, a perchloric acid ion, a carboxylic acid ion, and a nitric acid ion.

In formula (II), $R_4$, $R_5$ and $R_6$ are each preferably a group having from 1 to 20 carbon atoms, and particularly preferably an aryl group having from 6 to 15 carbon atoms. m is preferably 1 or 2, and when m is 1, L is preferably a group having from 1 to 20 carbon atoms, and particularly preferably an alkyl or aryl group having from 1 to 15 total carbon atoms. When m is 2, the divalent organic group represented by L is preferably an alkylene group, an arylene group, or a divalent group formed by bonding these groups, as well as a divalent group formed by bonding these groups in combination with a group such as —CO—, —O—, —$NR_{12}$— (wherein $R_{12}$ represents a hydrogen atom, or one of the groups represented by $R_4$, $R_5$ and $R_6$, when the $R_{12}$ groups exist plurally, they may be the same or different and may be combined with each other), —S—, —SO—, and —$SO_2$—. When m is 2, L is particularly preferably a divalent group having from 1 to 20 total carbon atoms which bonds to the P atom via the carbon atom of L. When m is an integer of 2 or more, the plurality of $R_4$, $R_5$ and $R_6$ in the molecule may be the same or different.

n is preferably 1 or 2, and m is preferably 1 or 2. $X_1$ may be bonded to $R_4$, $R_5$, $R_6$ or L to form an intermolecular salt.

Many of the compounds represented by formula (II) are known, and some of them are commercially available. The general processes for production include a process in which a phosphinic acid is reacted with an alkylating agent such as alkyl halide or sulfonate; or a pair anion of phosphonium salt is ion-exchanged according to a usual process.

Typical examples of the compounds represented by formula (II) are described below, but the present invention should not be restricted thereto:

A-1

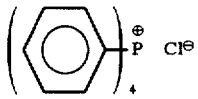

A-2

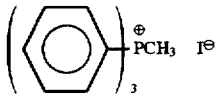

A-3

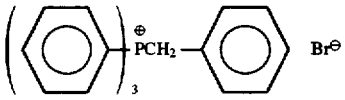

A-4

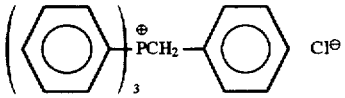

A-5

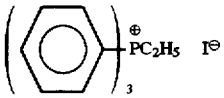

A-6

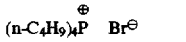

A-7

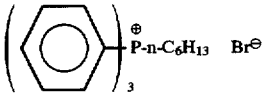

A-8

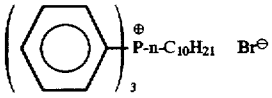

A-9

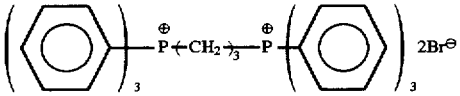

A-10

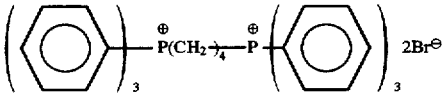

A-11

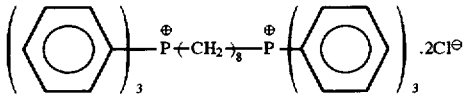

A-12

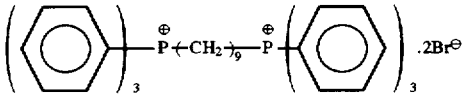

A-13

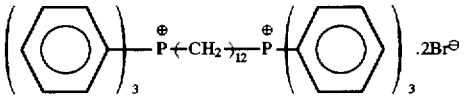

A-14

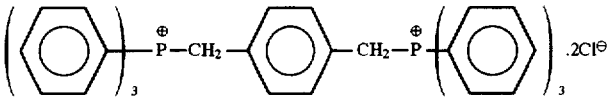

A-15

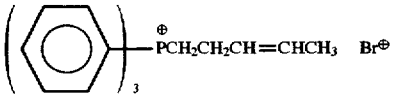

A-16

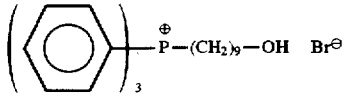

-continued
A-17
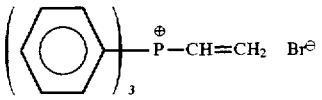
A-18
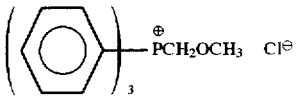
A-19
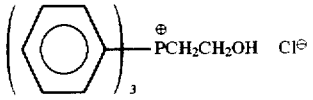
A-20
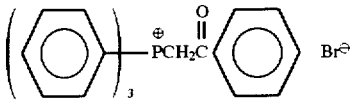
A-21
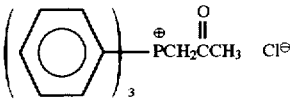
A-22
$(n\text{-}C_4H_9)_3\overset{\oplus}{P}CH_2CH_2OH\ \ Br^{\ominus}$
A-23
$(n\text{-}C_4H_9)_3\overset{\oplus}{P}C_2H_5.1/2.SO_4^{2\ominus}$
A-24
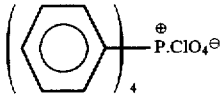
A-25
$Ph_3\overset{\oplus}{P}-(CH_2)_4COOH\ \ Br^{\ominus}$
A-26
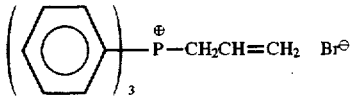
A-27
$(n\text{-}C_4H_9)_3\overset{\oplus}{P}\text{-}n\text{-}C_{16}H_{33}\ \ Br^{\ominus}$
A-28
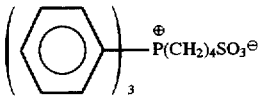
A-29
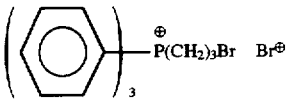
A-30
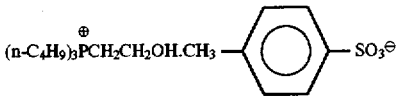
A-31
$(n\text{-}C_4H_9)_3\overset{\oplus}{P}CH_3I^{\ominus}$
A-32
$(HOCH_2)_3\overset{\oplus}{P}CH_3I^{\ominus}$
A-33
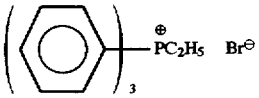
A-34
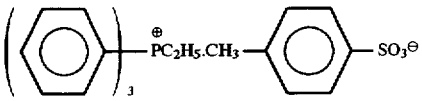
A-35
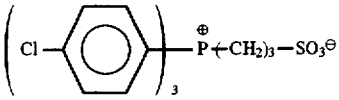
A-36
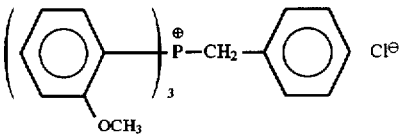
A-37
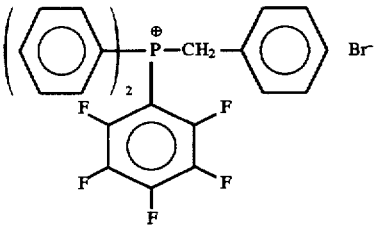
A-38
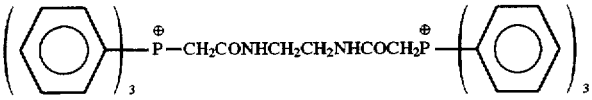
$2Cl^{-}$
A-39
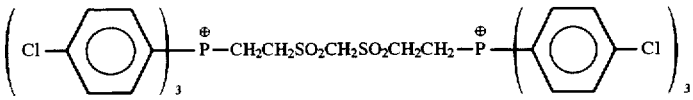
$2BF_4^{\ominus}$ -continued

A-40

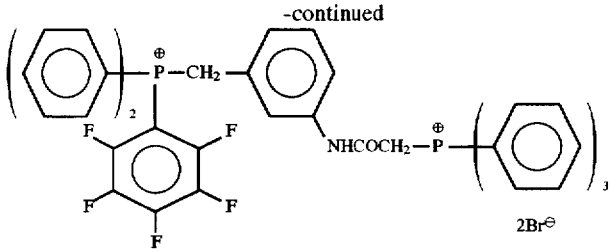

A-41

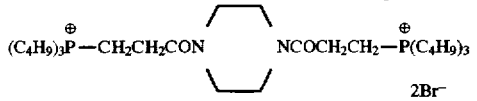

A-42

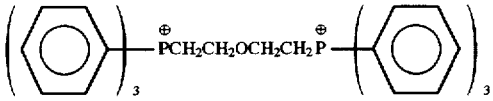

A-43

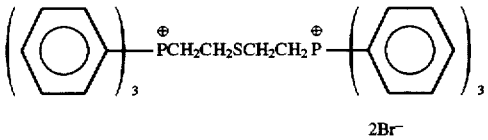

A-44

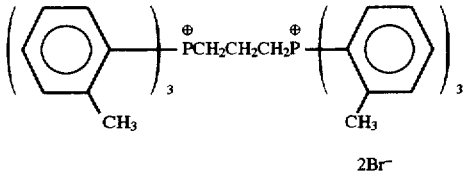

A-45

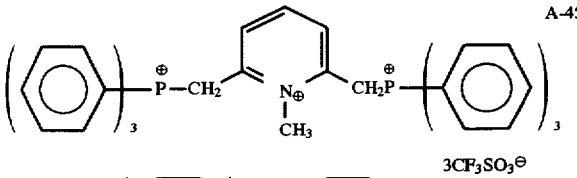

A-46

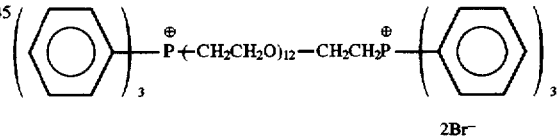

A-47

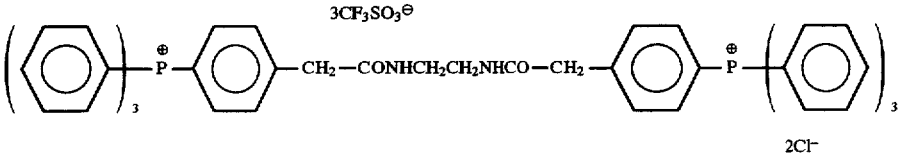

The compounds represented by formulae (III) and (IV) will now be described in detail.

In formulae (III) and (IV), A represents an organic group for forming a heterocyclic ring, and may contain a carbon atom, a hydrogen atom, an oxygen atom, a nitrogen atom, or a sulfur atom. The heterocyclic group formed by A may be condensed with a benzene ring. A preferably forms a 5- or 6-membered ring, and more preferably a pyridine ring.

The divalent group represented by B or C is preferably an alkylene group, an arylene group, an alkenylene group, —$SO_2$—, —SO—, —O—, —S—, and —N($R_{13}$)—, and combinations thereof. $R_{13}$ represents an alkyl group, an aryl group, or a hydrogen atom. B and C are each particularly preferably an alkylene group, an arylene group, —O— and —S—, and combinations thereof.

$R_7$ and $R_8$ are each preferably an alkyl group having from 1 to 20 carbon atoms, which may be the same or different. The alkyl group may be substituted with one or more substituents, and examples of the substituents include a halogen atom (e.g., chlorine, bromine), a substituted or unsubstituted alkyl group (e.g., methyl, hydroxyethyl), a substituted or unsubstituted aryl group (e.g., phenyl, tolyl, p-chlorophenyl), a substituted or unsubstituted acyl group (e.g., benzoyl, p-bromobenzoyl, acetyl), a sulfo group, a carboxyl group, a hydroxyl group, an alkoxy group (e.g., methoxy, ethoxy), an aryloxy group, an amido group, a sulfamoyl group, a carbamoyl group, a ureido group, an unsubstituted or alkyl-substituted amino group, a cyano group, a nitro group, an alkylthio group, and an arylthio group. $R_7$ and $R_8$ are each preferably an alkyl group having from 1 to 10 carbon atoms. Preferable examples of the substituents include an aryl group, a sulfo group, a carboxyl group and a hydroxyl group.

$R_9$ and $R_{10}$ each represents a hydrogen atom or a substituent. Examples of the substituent are selected from the substituents exemplified as the substituents of alkyl groups represented by $R_7$ and $R_8$. $R_9$ and $R_{10}$ are each preferably a substituent having from 0 to 10 carbon atoms, and more specifically an aryl-substituted alkyl group or a substituted or unsubstituted aryl group.

$X_2$ represents an anion, but if an intermolecular salt is formed, $X_2$ does not exist. Examples of $X_2$ include a chlorine ion, a bromine ion, an iodine ion, a nitric acid ion, a sulfuric acid ion, a p-toluenesulfonic acid ion, and an oxalate ion.

Typical examples will now be described below, but the present invention is not restricted thereto. The compounds according to the present invention can easily be synthesized by the process known (*Quart. Rev.* 16, 163 (1962)).

Specific examples of the compounds represented by formulae (III) and (IV) will now be described, but the present invention should not be restricted thereto.

B-1
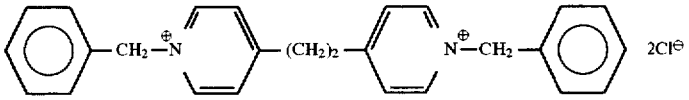
B-2
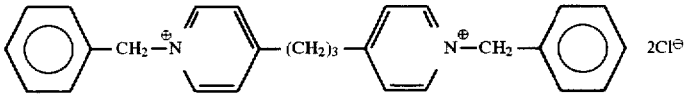
B-3
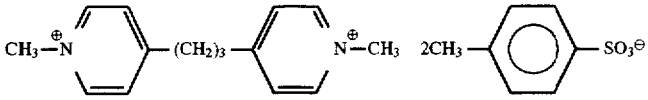
B-4
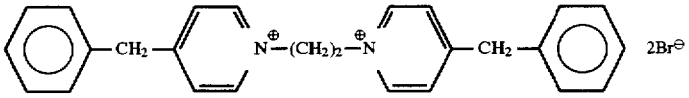
B-5
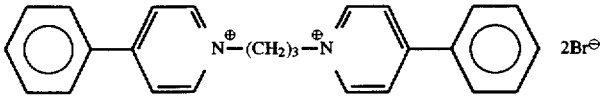
B-6
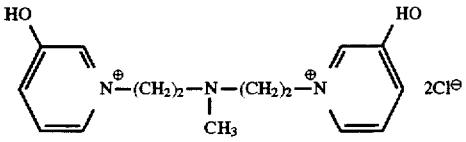
B-7
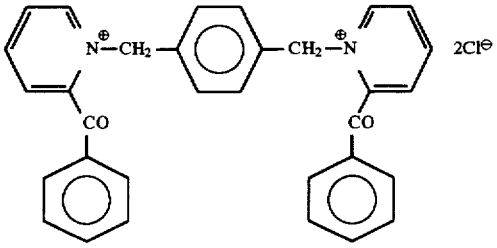
B-8
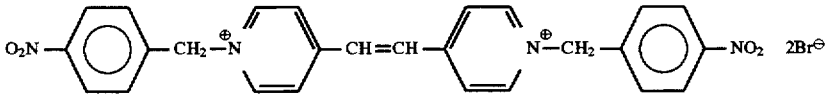
B-9
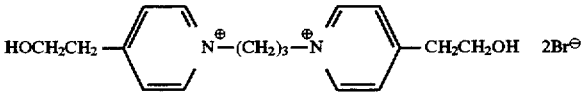
B-10
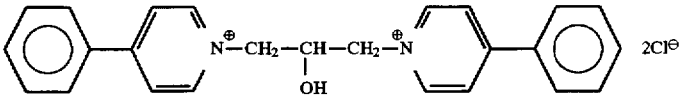
B-11
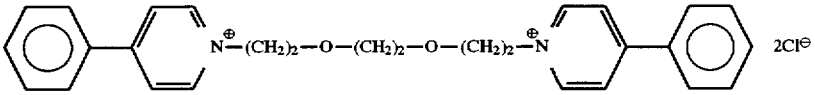
B-12
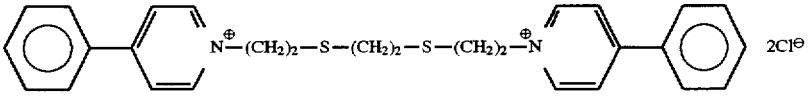
B-13
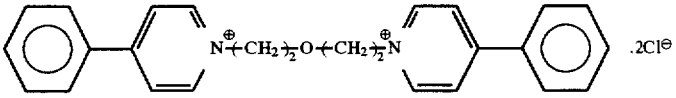

-continued

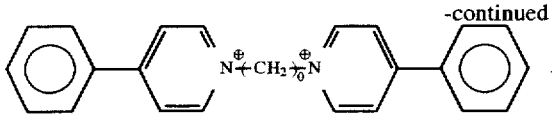

B-14

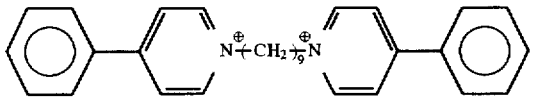

B-15

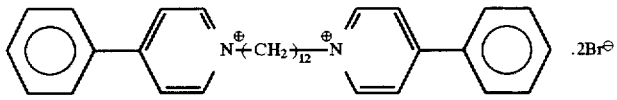

B-16

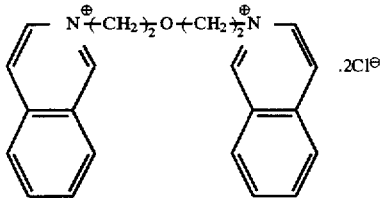

B-17

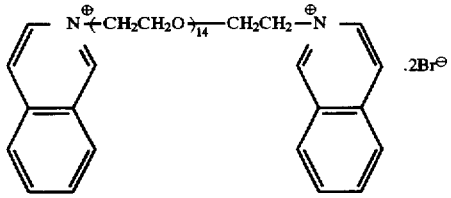

B-18

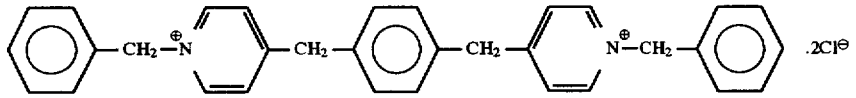

B-19

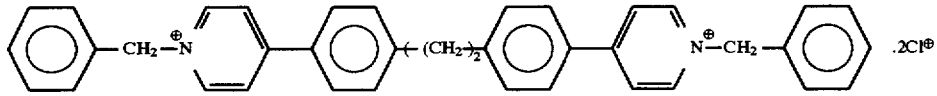

B-20

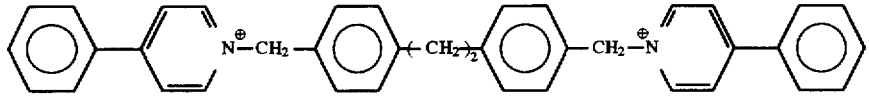

B-21

The compound represented by formula (V) will now be described in detail.

The nitrogen-containing heterocyclic aromatic ring represented by Z may contain a carbon atom, a hydrogen atom, an oxygen atom or a sulfur atom in addition to the nitrogen atom, and a benzene ring may be further condensed therewith. The heterocyclic ring formed is preferably a 5- or 6-membered ring, more preferably a pyridine ring, a quinoline ring, or an isoquinoline ring.

$R_{11}$ is preferably an alkyl group having from 1 to 20 carbon atoms, and may be a straight-chain, branched, or cyclic alkyl group. The alkyl group has more preferably from 1 to 12 carbon atoms, most preferably from 1 to 8, carbon atoms.

$X_3^-$ represents an anion, but $X_3^-$ does not exist if a intermolecular salt is formed. Examples of $X_3^-$ include a chlorine ion, a bromine ion, an iodine ion, a nitric acid ion, a sulfuric acid ion, a p-toluenesulfonic acid ion, and an oxalate ion.

The groups represented by Z and $R_{11}$ may be substituted with one or more substituents. Examples of preferable substituents include a halogen atom (e.g., chlorine, bromine), a substituted or unsubstituted aryl group (e.g., phenyl, tolyl, p-chlorophenyl), a substituted or unsubstituted acyl group (e.g., benzoyl, p-bromobenzoyl, acetyl), a sulfo group, a carboxyl group, a hydroxyl group, an alkoxy group (e.g., methoxy, ethoxy), an aryloxy group, an amido group, a sulfamoyl group, a carbamoyl group, a ureido group, an unsubstituted or alkyl-substituted amino group, a cyano group, a nitro group, an alkylthio group, and an arylthio group. The substituents are more preferably an aryl group, a sulfo group, a carboxyl group or a hydroxyl group.

In addition, as the substituents of Z, a substituted or unsubstituted alkyl group (e.g., methyl, hydroxyethyl), a substituted or unsubstituted aralkyl group (e.g., benzyl, p-methoxyphenethyl) are also preferred.

Typical examples will now be described below, but the present invention is not restricted thereto. The compounds according to the present invention can easily be synthesized by the process known (*Quart. Rev.* 16, 163 (1962)).

Specific examples of the compounds represented by formula (V) will now be described, but the present invention should not be restricted thereto.

C-1
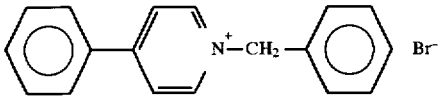
C-2
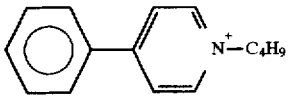
C-3
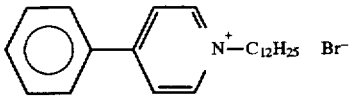
C-4
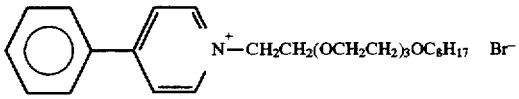
C-5
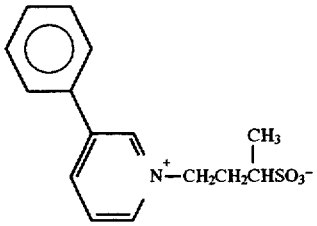
C-6
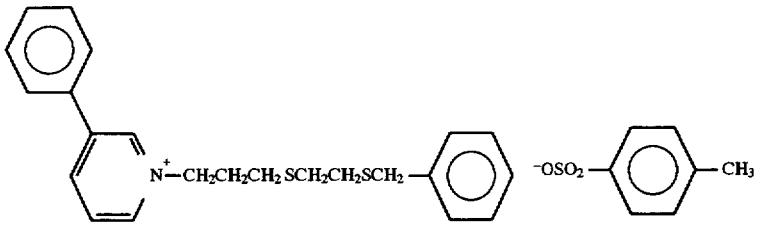
C-7
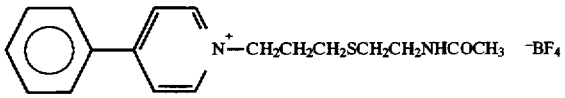
C-8
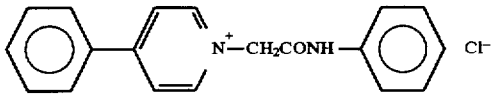
C-9
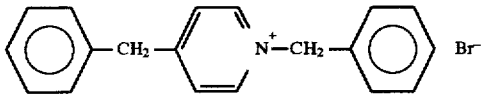
C-10
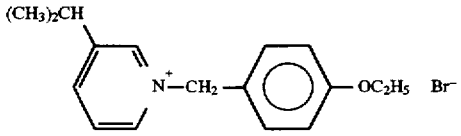
C-11
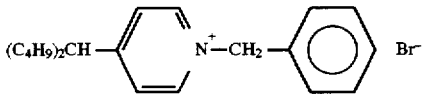
C-12
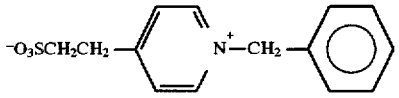

-continued

C-13

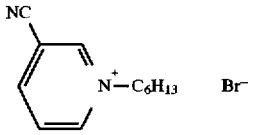

C-14

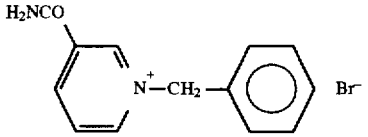

C-15

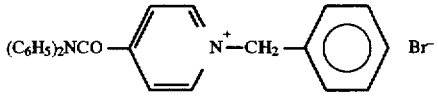

C-16

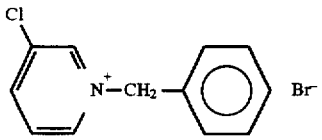

C-17

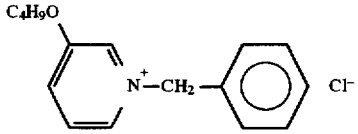

C-18

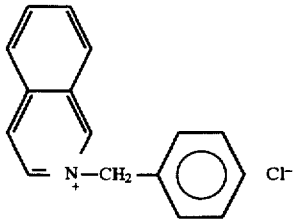

C-19

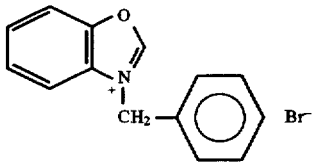

C-20

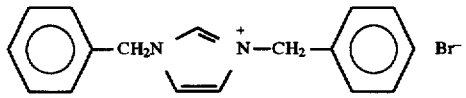

The amino compound acting as an internal nucleating accelerator will now be described in detail.

Available amino compounds are described in U.S. Pat. No. 4,975,354, and include amino compounds (1) having at least one secondary amino or tertiary amino group, (2) containing at least three repeating ethylene oxy units in the structure thereof and (3) exhibiting at least one, preferably at least three, and more preferably at least four, partition coefficients.

Examples of the amino compound acting as an internal nucleating accelerator include monoamines, diamines, and polyamines. These amines may be aliphatic amines or may contain an aromatic moiety or a heterocyclic moiety. The aliphatic, aromatic, and heterocyclic groups existing in the amine may be substituted or unsubstituted. The amine compound according to the present invention is a compound having at least 20 carbon atoms.

The amino compound which can be used as an internal nucleating accelerator is a bis type tertiary amine possessing at least three partition coefficients represented by the following formula:

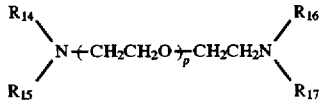

wherein p represents an integer of from 3 to 50, preferably from 10 to 50; $R_{14}$, $R_{15}$, $R_{16}$ and $R_{17}$ each independently represents an alkyl group having from 1 to 8 carbon atoms, or $R_{14}$ and $R_{15}$ represent an atomic group necessary for forming a heterocyclic ring with each other, or $R_{16}$ and $R_{17}$ represent an atomic group necessary for forming a heterocyclic ring with each other.

The amino compound which can be used as an internal nucleating accelerator is a bis type secondary amine possessing at least three partition coefficients represented by the following formula:

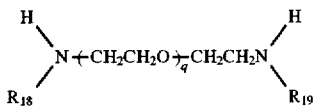

wherein q represents an integer of from 3 to 50, preferably from 10 to 50; $R_{18}$ and $R_{19}$ each independently represents a straight-chain or branched, substituted or unsubstituted alkyl group having at least 4 carbon atoms. Preferably, a group comprising at least three repeating ethyleneoxy units is directly bonded to the tertiary amino nitrogen atom, and most preferably, a group comprising at least three repeating ethyleneoxy units is bonded to the tertiary amino nitrogen atom of the bis type tertiary amino compound.

The most preferable amino compound is a compound represented by the following formula, wherein Pr represents an n-propyl group.

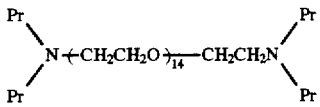

Another amino compound useful as an internal nucleating accelerator is described in U.S. Pat. No. 4,914,003, and represented by the following formula:

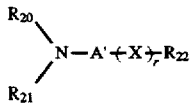

wherein $R_{20}$ and $R_{21}$ each independently represents a substituted or unsubstituted alkyl group, or they may be connected with each other to form a ring; $R_{22}$ represents a substituted or unsubstituted alkyl, aryl or heterocyclic group; A' represents a divalent linking group; X represents —$CONR_{23}$—, —O—$CONR_{23}$, —$NR_{23}CO$—$CONR_{23}$'—, —$NR_{23}$—COO—, —COO—, —OC—O—, —CO—, —$NR_{23}CO$—, —$SO_2NR_{23}$—, —$NR_{23}SO_2$—, —$SO_2$—, —S— or —O—, wherein $R_{23}$ and $R_{23}$' each represents a hydrogen atom or a lower alkyl group; and r represents 0 or 1, provided that total carbon number contained in $R_{20}$, $R_{21}$, $R_{22}$ and A' are 20 or more.

Still another amino compound useful as an internal nucleating accelerator is an amino compound described in U.S. Pat. No. 5,030,547, and represented by the following formula:

$$Y_0[(A_0)_s B_0]_t$$

wherein $Y_0$ represents a group which accelerates the adsorption onto the silver halide; $A_0$ represents a divalent linking group; $B_0$ represents an amino group, an ammonium group or a nitrogen-containing heterocyclic group; s represents 1, 2 or 3; and t represents 1 or 2.

The amount of the compound represented by formula (II), (III), (IV) or (V) or the amino compound acting as an internal nucleating accelerator is not specifically restricted as long as an required amount is added according to the properties of the light-sensitive material. The amount used in the present invention is preferably from $1\times10^{-5}$ to $2\times10^{-2}$ mol/mol Ag, more preferably from $2\times10^{-5}$ to $1\times10^{-2}$ mol/mol Ag.

The compound represented by formula (II), (III), (IV) or (V), or the amino compound acting as an internal nucleating accelerator can be dissolved in an adequate organic solvent such as alcohol (e.g., methanol, ethanol, propanol, fluorinated alcohol), ketone (e.g., acetone, methyl ethyl ketone), diformamide, dimethylsulfoxide, and methylcellosolve.

They may also be dissolved in an oil such as dibutyl phthalate, tricresyl phosphate, glyceryl triacetate or diethyl phthalate by the emulsion dispersion method, which has already been well-known or dissolved with a co-solvent such as ethyl acetate or cyclohexanone and mechanically prepared into an emulsion dispersion. Otherwise, they can be made into a fine dispersion by the method known as a solid dispersing.

If the photographic material according to the present invention is used for, for example, photographing or scanner, the silver halide emulsion comprises preferably silver chloride, or silver bromochloride or silver bromoiodochloride having a sliver chloride content of 50 mol % or more, more preferably from 50 to 70 mol %. The content of silver iodide is preferably less than 5 mol %, more preferably less than 2 mol %.

If the photographic material according to the present invention is used for, for example, dot-to-dot working (contact working), the silver halide emulsion comprises preferably silver halide having a sliver chloride content of 90 mol % or more, more preferably 95 mol % or more, or silver chlorobromide or silver chloroiodobromide having a silver bromide content of from 0 to 10 mol %. If the ratio of the silver bromide or silver iodide is increased, it is not preferred because the safe light safety in daylight is deteriorated and $\gamma$ is lowered.

The silver halide for use in the present invention is preferably a so-called core-shell type silver halide, and in particular a core-shell type silver halide in which the transition metal content in the shell is larger than the core is preferable.

Photographic emulsions for use in the present invention can be prepared using methods described in, e.g., P. Glafkides, *Chemie et Physique Photographique*, Paul Montel, Paris (1967), G. F. Duffin, *Photographic Emulsion Chemistry*, The Focal Press, London (1966), V. L. Zelikman et al, *Making and Coating Photographic Emulsion*, The Focal Press, London (1964).

Suitable methods for reacting a water-soluble silver salt with a water-soluble halide include, e.g., a single jet method, a double jet method, or a combination thereof.

A method in which silver halide grains are produced in the presence of excess silver ion (what is called reverse mixing method) can be employed. On the other hand, the controlled double jet method, in which the pAg of the liquid phase wherein silver halide grains are to be precipitated is maintained constant, may be employed. Further, it is preferable to carry out the grain formation using the so-called silver halide solvent, such as ammonia, thioethers and tetrasubstituted thioureas. Preferably, tetrasubstituted thioureas are used as the silver halide solvent, which are disclosed in JP-A-53-82408 and JP-A-55-77737. As for the thioureas, tetramethylthiourea and 1,3-dimethyl-2-imidazolidinethione are preferably used.

According to the controlled double jet method and the grain formation method using a silver halide solvent, a silver halide emulsion having a regular crystal shape and a narrow distribution of grain sizes can be obtained with ease, and so these methods are useful for making the silver halide emulsions used in the present invention.

The incorporation of the above-mentioned water-soluble metal complex in the silver halide particles is preferably carried out in such a manner that when a water-soluble silver salt and a water-soluble halide solution are simultaneously mixed, the complex is added to the silver salt or the halide solution. Alternatively, when a silver salt and a halide solution are simultaneously mixed, the complex may be added as a third solution to prepare a silver halide particle by a method of mixing the three solutions.

For the purpose of rendering the grain sizes uniform, it is also preferable that the grain growth is accelerated within the limits of critical saturation degree by using a method of changing the addition speed of silver nitrate or an alkali halide depending on the speed of grain growth, as described in British Patent No. 1,535,016, JP-B-48-36890 and JP-B-52-16364, or a method of changing the concentrations of the aqueous solutions, as described in British Patent No. 4,242,445 and JP-A-55-158124.

The particle size of the silver halide emulsion, particularly used for dot-to-dot working, of the present invention is preferably less than 0.20 μm. The lower limit thereof is preferably 0.01 μm, and more preferably 0.05 μm.

When the silver halide particles according to the present invention are prepared, they are mixed at a reaction temperature of 50° C. or less, preferably 40° C. or less, and more preferably 30° C. or less, at a high rotation speed enough with uniformly stirring at a silver electric potential of 70 mV or more, preferably from 80 mV to 120 mV, to obtain good results.

In the silver halide emulsion according to the present invention, the monodisperse emulsion preferably has a variation coefficient of 20% or less, preferably 15% or less.

The term "variation coefficient (%)" used herein means a value obtained by dividing the standard deviation of the particle size by the average value of the particle size and multiplying by 100.

The silver halide particles of the present invention have preferably a regular crystal such as cube and octahedron.

The present photographic material may contain only one kind of silver halide emulsion or not less than two kinds of silver halide emulsions (differing in average grain size, halide composition, crystal habit or chemical sensitization condition).

The silver halide emulsion for use in the present invention may be preferably chemically sensitized. Examples of the chemical sensitization include known methods, such as a sulfur sensitization method, a selenium sensitization method, a tellurium sensitization method, a noble metal sensitization method, and a reduction sensitization method. Preferably, the silver halide emulsion is sensitized with a selenium sensitizer or a tellurium sensitizer. These methods can be used alone or in combination. In the combined use, it is preferable to combine, e.g., a sulfur sensitization method and a gold sensitization method, a sulfur sensitization method, a selenium sensitization and a gold sensitization method, or a sulfur sensitization method, a tellurium sensitization method and a gold sensitization method.

In the sulfur sensitization method in the present invention, the sensitization can be generally effected by adding a sulfur sensitizer to an emulsion and stirring the emulsion for a prescribed time under a temperature of 40° C. or more. As for the sulfur sensitizer, known compounds including not only sulfur compounds contained in gelatin but also thiosulfates, thioureas, thiazoles, and rhodanines can be used. Of these sulfur sensitizers, thiosulfates and thiourea compounds are preferred. The amount of a sulfur sensitizer added, though it is changed depending on various conditions, such as the pH and the temperature at the time of chemical sensitization and the size of silver halide grains, is in the range of $10^{-7}$ to $10^{-2}$ mol, preferably $10^{-5}$ to $10^{-3}$ mol, per mol of silver halide.

Selenium sensitizers for use in the present invention include known selenium compounds. In general, selenium sensitization can be effected by adding an unstable selenium compound and/or a nonunstable selenium compound to the silver halide emulsion and agitating the resulting emulsion at a high temperature, preferably 40° C. or more, for a definite time. Suitable examples of the unstable selenium compounds include those disclosed in JP-B-44-15748, JP-B-43-13489, JP-A-4-25832, JP-A-4-107442 and JP-A-4-324855. The compounds represented by formula (VIII) or (IX) described in JP-A-4-324855 are preferably used.

Tellurium sensitizers for use in the present invention are compounds capable of producing silver telluride, which is presumed to act as a sensitization nucleus, at the surface or the inside of silver halide grains. The production rate of silver telluride in a silver halide emulsion can be examined by the method disclosed in JP-A-5-313284.

Specific examples of the tellurium sensitizers include the compounds disclosed in U.S. Pat. Nos. 1,623,499, 3,320,069 and 3,772,031; British Patent Nos. 235,211, 1,121,496, 1,295,462 and 1,396,696; Canadian Patent No. 800,958, JP-A-4-204640, JP-A-4-271341, JP-A-4-333043 and JP-A-5-303157; *J. Chem. Soc. Commun.*, 635 (1980); ibid. 1102 (1979); ibid. 645 (1979); *J. Chem. Soc. Perkin. Trans.*, 1,2191 (1980); S. Patai (compiler), *The Chemistry of Organic Selenium and Tellurium Compounds*, Vol. 1 (1986); and ibid. Vol. 2 (1987). In particular, the compounds represented by formulae (II), (III) and (IV) in JP-A-5-313284 are preferred.

The amounts of selenium and tellurium sensitizers for use in the present invention, though they depend on the conditions under which the silver halide grains are ripened chemically, are generally from $10^{-8}$ to $10^{-2}$ mol, preferably from $10^{-7}$ to $10^{-3}$ mol, per mol of silver halide. The chemical sensitization, although the present invention does not impose any particular restriction thereon, is generally carried out at a pH of from 5 to 8, at a pAg of from 6 to 11, preferably from 7 to 10, and at a temperature of from 40° to 95° C., preferably from 45° to 85° C.

Examples of the noble metal sensitizers for use in the present invention include gold, platinum, palladium and iridium. In particular, gold sensitizers are preferred. Suitable examples of such gold sensitizers include chloroauric acid, potassium chloroaurate, potassium aurithiocyanate and auric sulfide. These sensitizers can be used in an amount of from $10^{-7}$ to $10^{-2}$ mol per mol of silver halide.

In a process of producing silver halide emulsion grains for use in the present invention or allowing the produced grains to ripen physically, a cadmium salt, a zinc salt, a lead salt, and a thallium salt may be present.

Further, reduction sensitization can be adopted in the present invention. Examples of the reduction sensitizer include stannous salts, amines, formamidinesulfinic acid and silane compounds.

To the silver halide emulsions for use in the present invention, thiosulfonic acid compounds may be added according to the method described in European Patent (EP) No. 293,917.

In the present invention, the photographic material suitable for high illumination exposure such as scanner exposure and the photographic material suitable for line drawing photographing may contain a rhodium compound to obtain a high contrast or a low fog.

The rhodium compounds for use in the present invention include water-soluble ones. Suitable examples thereof include a rhodium(III) halide compound and a rhodium complex salt containing as a ligand halogen, amine, oxalate, such as a hexachlororhodium(III) complex salt, a hexabromorhodium(III) complex salt, a hexaamminerhodium(III) complex salt and a trioxalatorhodium(III) complex salt. In using these rhodium compounds, they are dissolved in water or an appropriate solvent. In order to stabilize the solution of a rhodium compound, a conventional method, that is, a method of adding an aqueous solution of halogenated acid (e.g., hydrochloric acid, hydrobromic acid, hydrofluoric acid) or an alkali halide (e.g., KCl, NaCl, KBr, NaBr), can be adopted. Instead of using a water-soluble rhodium compound, it is possible to incorporate rhodium into emulsion grains by adding rhodium-doped silver halide grains to the silver halide preparation system and dissolving the grains therein.

These compounds can be properly added at the time silver halide emulsion grains are formed, or at any stage prior to the emulsion coating. In particular, they are preferably added at the time the emulsion is formed and thereby to be incorporated into silver halide grains.

Furthermore, the silver halide emulsion for a photographic material for dot-to-dot working preferably contains a transition metal complex. Examples of the transition metal include Rh, Ru, Re, Os, Ir and Cr.

Examples of the ligand include a nitrosyl ligand or thionitrosyl ligand, a halogenated ligand (e.g., fluoride, chloride, bromide, iodide), a cyanine ligan, a cyanate ligand, a thiocyanate ligand, a selenocyanate ligand, a tellurocyanate ligand, an acid ligand and an aquo ligand. When the aquo ligand exists, the number of the aquo ligand(s) is preferably one or two.

When the rhodium atom is incorporated, it is added in any form such as a monosalt or a complex salt during the grain formation.

Examples of the rhodium salt include rhodium chloride, rhodium dichloride, rhodium trichloride, and ammonium hexachlororhodium acid. Preferred are a water-soluble halide complex compound of tertiary rhodium such as hexachlororhodium (III) acid and salts thereof (e.g., ammonium salt, sodium salt, potassium salt).

The silver halide emulsion for use in the present invention preferably contains at least one complex selected from a rhodium complex, a ruthenium complex, a rhenium complex and an osmium complex in an amount of from $1\times10^{-8}$ to $5\times10^{-4}$ per mol of silver.

When the silver halide emulsion contains silver chloride in an amount of 50 mol % or more and is used for photographing or scanner exposure, the emulsion preferably contains at least one complex selected from a rhodium complex, a ruthenium complex, a rhenium complex and an osmium complex in an amount of from $1\times10^{-8}$ to $1\times10^{-6}$, more preferably from $5\times10^{-8}$ to $1\times10^{-6}$, per mol of silver.

When the silver halide emulsion for dot-to-dot working contains silver chloride in an amount of 90 mol % or more, more preferably 95 mol % or more, and comprises particles having an average particle size of less than 0.2 μm, the emulsion preferably contains at least one complex selected from a rhodium complex and a ruthenium complex in an amount of from $1\times10^{-6}$ to $5\times10^{-4}$, more preferably from $5\times10^{-6}$ to $1\times10^{-4}$, per mol of silver to obtain ultrahigh contrast.

The distribution of the metals in the silver halide particles is not particularly limited, but it is preferred that the number of the metals existing in the outside of the particles is larger.

The silver halide photographic material for use in the present invention preferably contains an iridium compound, an iridium salt or an iridium complex salt to obtain high sensitivity or high contrast.

The iridium compounds for use in the present invention include various ones, e.g., hexachloroiridium, hexaammineiridium, trioxalatoiridium, hexacyanoiridium, iridium trichoride, iridium tetrachloride, potassium hexachloroiridium(III) acid, potassium hexachloroiridium (IV) acid, and ammonium hexachloroiridium(III) acid. In using these iridium compounds, they are dissolved in water or an appropriate solvent. In order to stabilize the solution of an iridium compound, a conventional method, that is, a method of adding an aqueous solution of halogenated acid (e.g., hydrochloric acid, hydrobromic acid, hydrofluoric acid) or an alkali halide (e.g., KCl, NaCl, KBr, NaBr), can be adopted. Instead of using a water-soluble iridium compound, it is possible to incorporate iridium into emulsion grains by adding iridium-doped silver halide grains to the silver halide preparation system and dissolving the grains therein.

The total amount added of the iridium compound is from $1\times10^{-8}$ to $5\times10^{-6}$ mol, preferably from $5\times10^{-8}$ to $1\times10^{-6}$ mol, per mol of silver halide which is finally formed.

These compounds can be properly added at the time silver halide emulsion grains are formed, or at any stage prior to the emulsion coating. In particular, they are preferably added before physical ripening of the silver halide forming step, more preferably at the time the emulsion is formed, and thereby to be incorporated into silver halide grains.

The silver halide particles for use in the present invention may contain metal atoms such as iron, cobalt, nickel, palladium, platinum, gold, thallium, copper, and zinc. These metals are preferably added in an amount of from $1\times10^{-9}$ to $1\times10^{-4}$ mol per mol of silver halide. These metals are contained by adding in the form of a metal salt such as a single salt, a double salt and a complex salt during particle preparation.

Transition metal complexes shown below are also preferably used.

1. $[Ru(NO)Cl_5]^{-2}$
2. $[Ru(NO)_2Cl_4]^{-1}$
3. $[Ru(NO)(H_2O)Cl_4]^{-1}$
4. $[Ru(NO)Cl_5]^{-2}$
5. $[Rh(NO)Cl_5]^{-2}$
6. $[Re(NO)CN_5]^{-2}$
7. $[Re(NO)ClCN_4]^{-2}$
8. $[Rh(NO)_2Cl_4]^{-1}$
9. $[Rh(NO)(H_2O)Cl_4]^{-1}$
10. $[Ru(NO)CN_5]^{-2}$
11. $[(Ru(NO)Br_5]^{-2}$
12. $[Rh(NS)Cl_5]^{-2}$
13. $[Os(NO)Cl_5]^{-2}$
14. $[(Cr(NO)Cl_5]^{-3}$
15. $[Re(NO)Cl_5]^{-1}$
16. $[Os(NS)Cl_4(TeCN)]^{-2}$
17. $[Ru(NS)I_5]^{-2}$
18. $[Re(NS)_2Cl_4(SeCN)]^{-2}$
19. $[Os(NS)Cl(SCN)_4]^{-2}$
20. $[Ir(NO)Cl_5]^{-2}$

Spectral sensitizing dyes for use in the present invention are not particularly limited.

The amount of sensitizing dyes added is, though depending on the shape and the size of silver halide grains, from $4\times10^{-6}$ to $8\times10^{-3}$ mol per mol of silver halide. For example, if the size of silver halide grains is from 0.2 to 1.3 μm, it is preferable that the amount of sensitizing dyes added is from $2\times10^{-7}$ to $3.5\times10^{-6}$ mol, particularly preferably from $6.5\times10^{-7}$ to $2.0\times10^{-6}$ mol, per $m^2$ of surface area of silver halide grains.

The light-sensitive silver halide emulsions for use in the present invention may be spectrally sensitized with sensitizing dyes to extend their sensitivities to blue rays of relatively long wavelengths, green rays, red rays or infrared rays. Examples of the sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

The sensitizing dyes useful in the present invention include those described in *Research Disclosure*, Item 17643, Section IV-A (December 1978, p. 23); ibid., Item 1831, Section X (August 1978, p. 437) and the references cited in these literatures.

In special cases where various type of scanners are used for exposure, it is advantageous to choose sensitizing dyes which can impart spectral sensitivities suited for spectral properties of the light source of the scanner used.

For instance, it is advantageous to choose (A) the simple merocyanines disclosed in JP-A-60-162247, JP-A-2-48653, U.S. Pat. No. 2,161,331, West German Patent No. 936,071 and JP-A-5-11382 when an argon laser is used as a light source, (B) the trinuclear cyanine dyes disclosed in JP-A-50-62425, JP-A-54- 18726 and JP-A-59-102229 when an He—Ne laser is used as a light source, (C) the thiacarbocyanines disclosed in JP-B-48-42172, JP-B-51-9609, JP-B-55-39818, JP-A-62-284343 and JP-A-2-105135 when an LED or red semiconductor laser is used as a light source, and (D) the tricarbocyanines disclosed in JP-A-59-191032 and JP-A-60-80841 and the 4-quinoline nucleus-containing dicarbocyanines represented by formula (IIIa) or (IIIb) in JP-A-59-192242 and JP-A-3-67242 when an infrared semiconductor layer is used as a light source.

These sensitizing dyes may be used alone or in combination. Combinations of sensitizing dyes are often used for the purpose of supersensitization. Materials which can exhibit a supersensitizing effect in combination with sensitizing dyes although they themselves do not spectrally sensitize silver halide emulsions or do not absorb light in the visible region may be incorporated in the emulsions.

Useful sensitizing dyes, supersensitizing combinations of dyes, and materials capable of exhibiting a supersensitizing effect are described in, e.g., *Research Disclosure*, Vol. 176, Item 17643, Section IV-J (December 1978, p. 23).

In particular, the dyes cited below are preferably used for an argon laser light source:

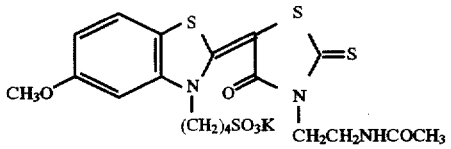

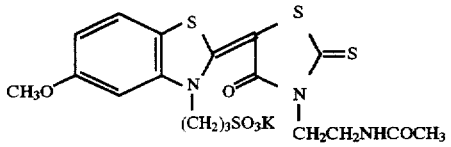

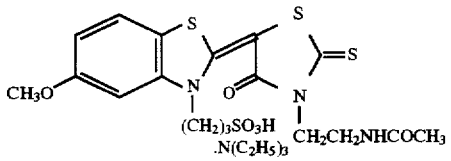

-continued

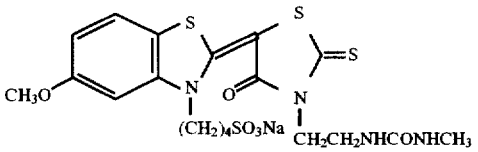

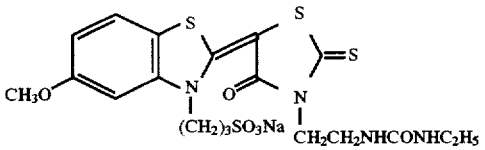

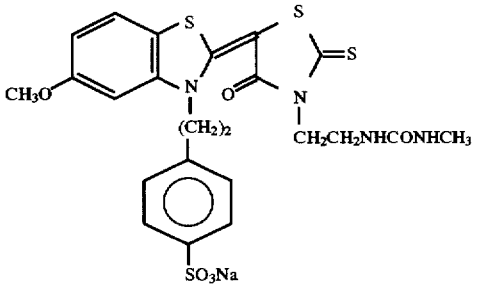

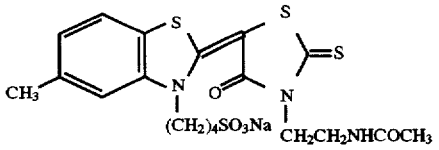

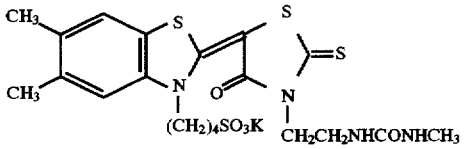

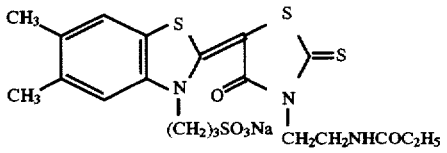

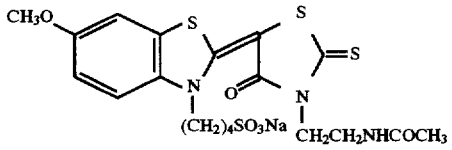

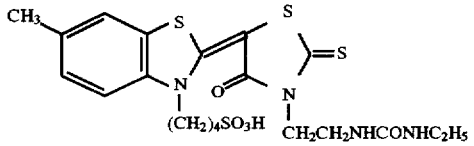

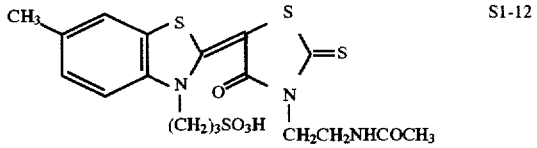

-continued

S1-13

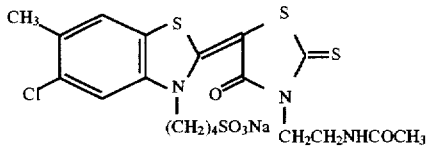

In addition to the dyes illustrated above, the sensitizing dyes represented by formula (I) in JP-A-6-75322 (from page 8, the end line, to page 13, 4th line) are particularly suitable for a helium-neon laser light source. Typical representatives of such sensitizing dyes are illustrated below. In addition, the sensitizing dyes represented by formula (I) of JP-A-6-75322 can be preferably used.

S2-1

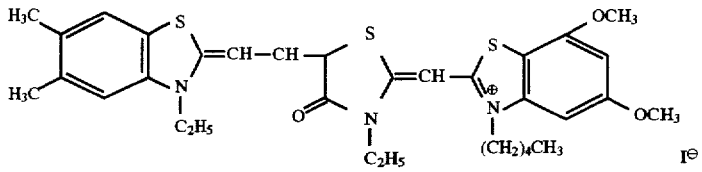

S2-2

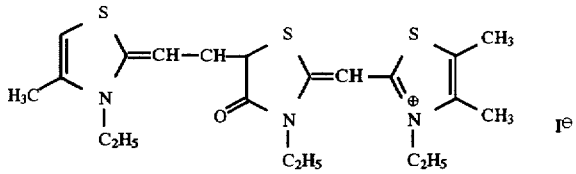

S2-3

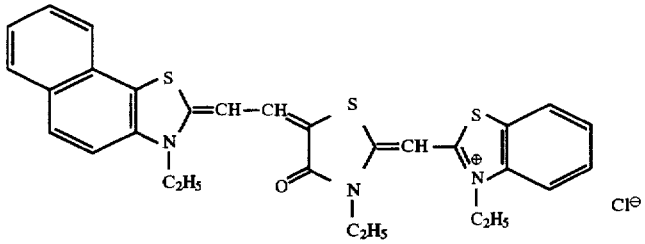

S2-4

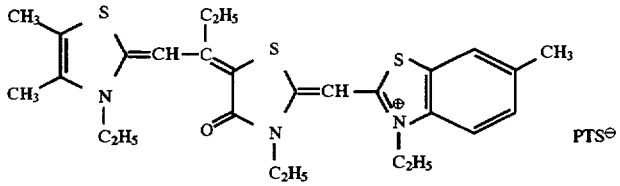

S2-5

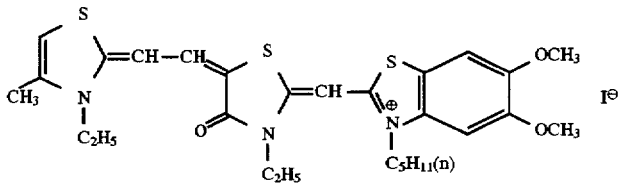

S2-6

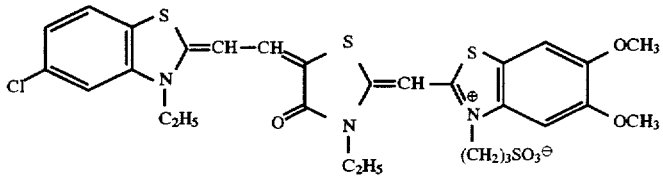

S2-7

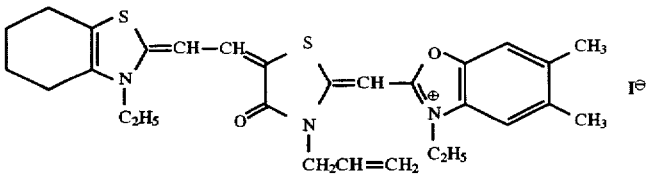

-continued
S2-8
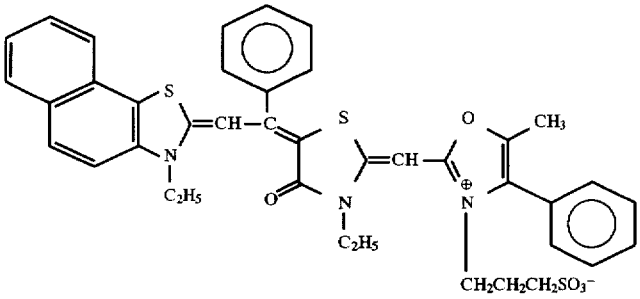
For LED and red semiconductor laser light sources, the dyes illustrated below are particularly suitable.
S3-1
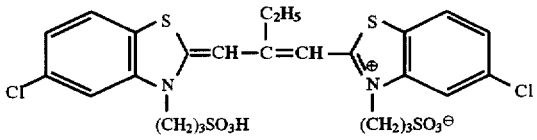
S3-2
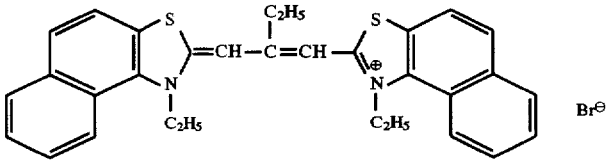
S3-3
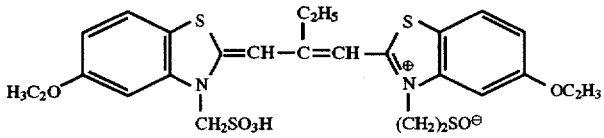
S3-4
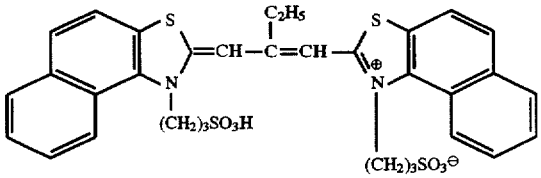
S3-5
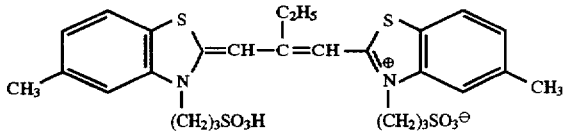
S3-6
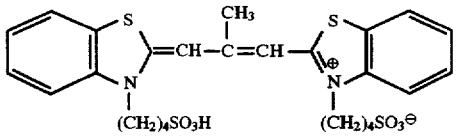
S3-7
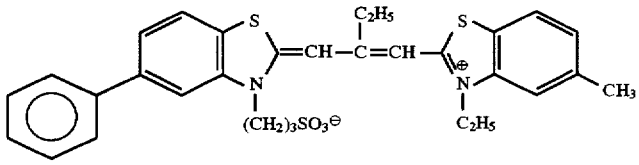
S3-8
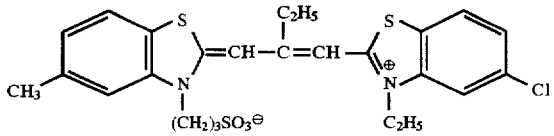

For an infrared semiconductor laser light source, the dyes illustrated below are particularly suitable.
S4-1
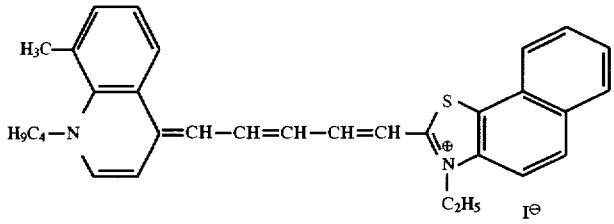
S4-2
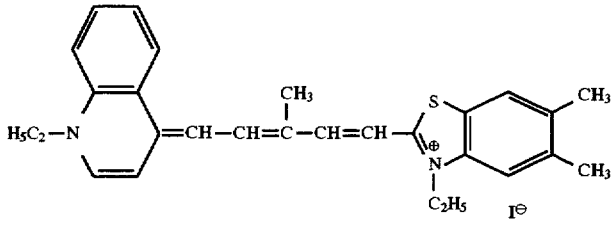
S4-3
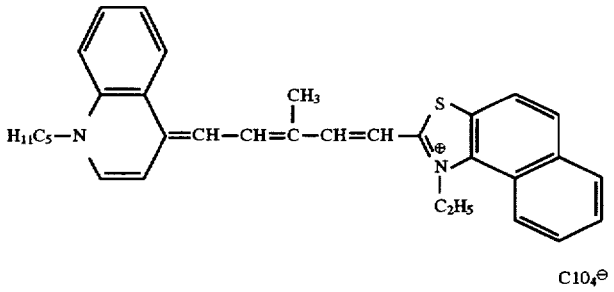
S4-4
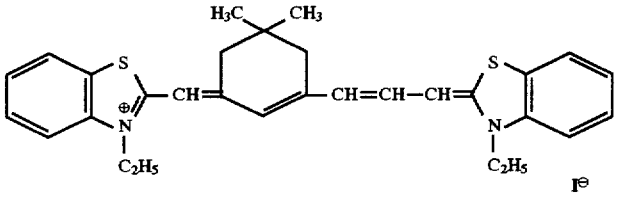
S4-5
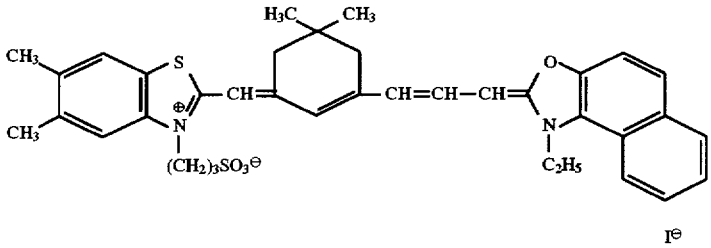
S4-6
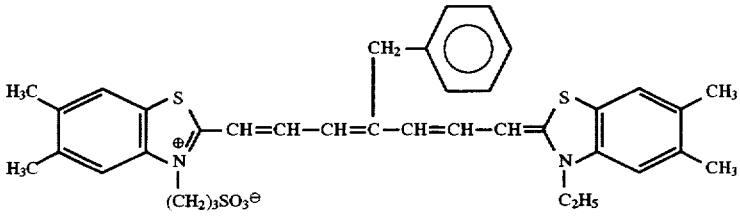

-continued
S4-7
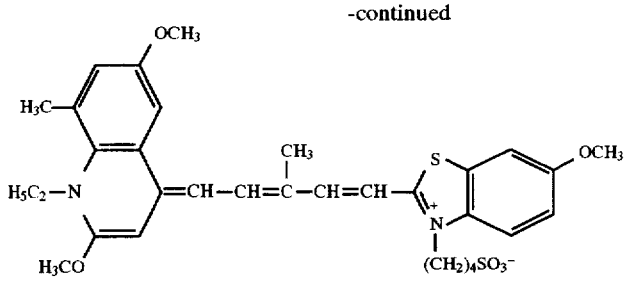
S4-8
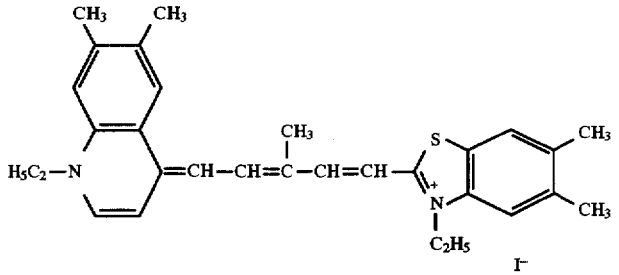
S4-9
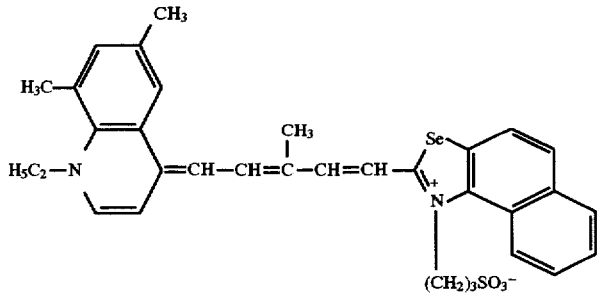
For a white light such as camera photographing, the sensitizing dyes represented by general formula (IV) in JP-A-7-36139 (from page 20, 14th line, to page 22, 23rd line) are suitable. Specific examples thereof are illustrated below.
S5-1
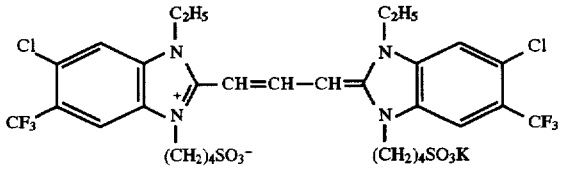
S5-2
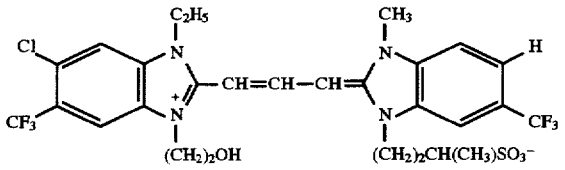
S5-3
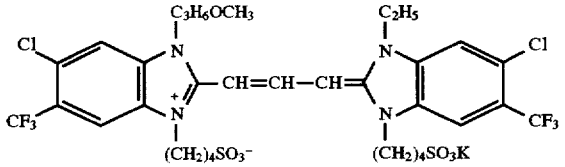

-continued
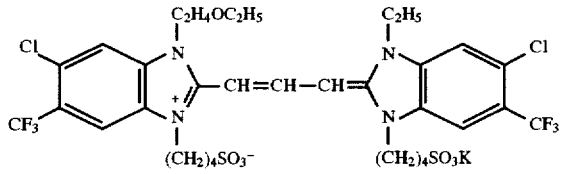
S5-4
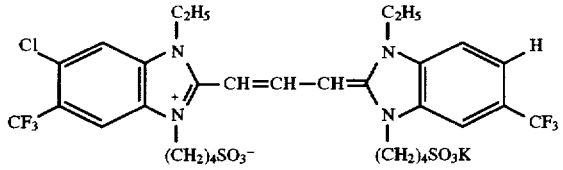
S5-5
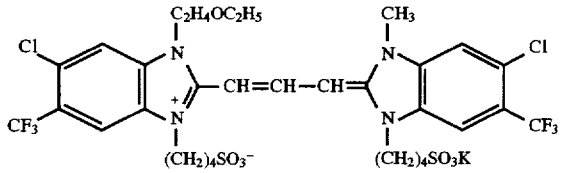
S5-6
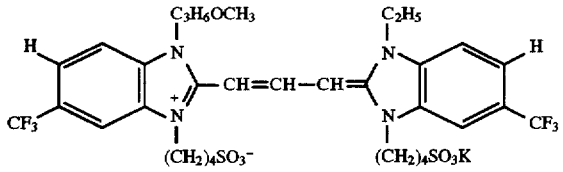
S5-7
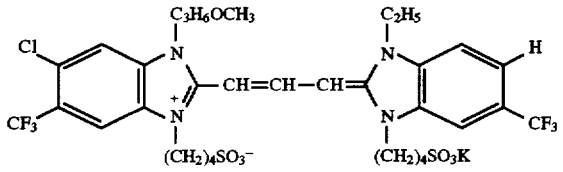
S5-8
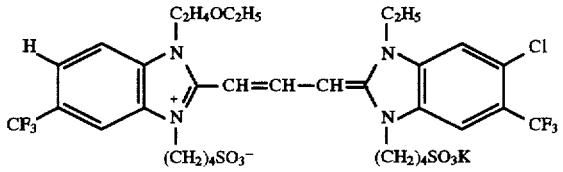
S5-9
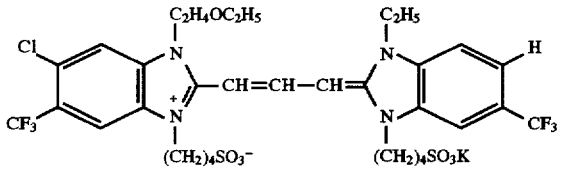
S5-10
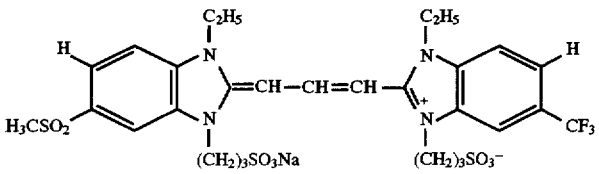
S5-11
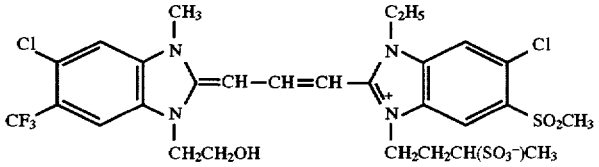
S5-12

-continued

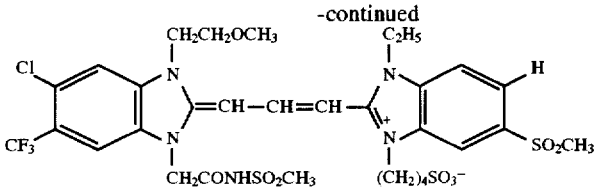

S5-13

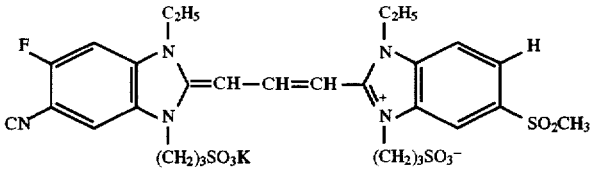

S5-14

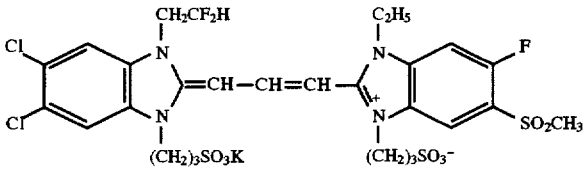

S5-15

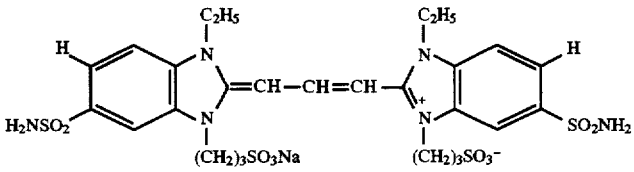

S5-16

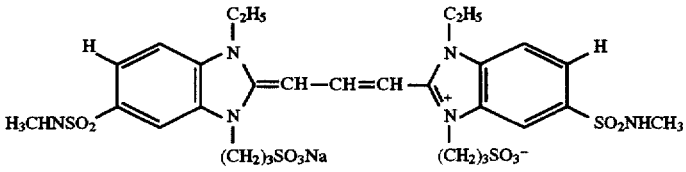

S5-17

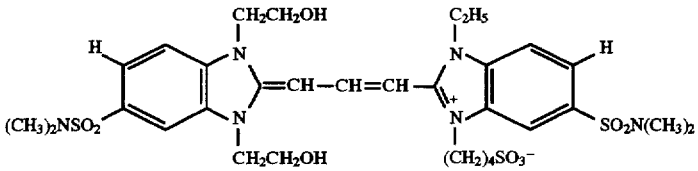

S5-18

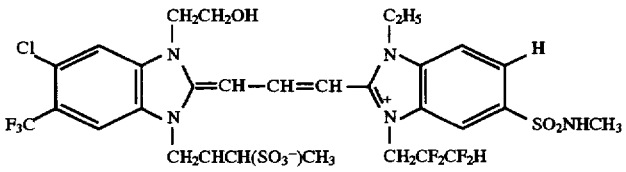

S5-19

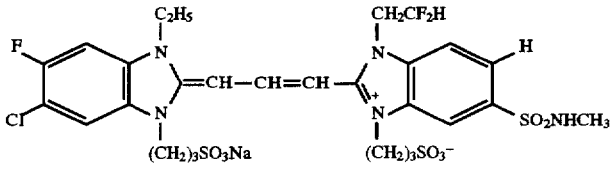

S5-20

The silver halide photographic material according to the present invention is developed with a developer containing a dihydroxybenzene developing agent as a developing agent and an auxiliary developing agent exhibiting a super additive property to the developing agent and having a pH of from 9.5 to less than 11.0.

In developing, a usual automatic developing machine can be used. The developer with which the developing tank is filled at the initiation of developing is called a developing initiator (mother liquid) and the developer to be replenished in the developing tank during the continuous development is called a developer replenisher. In the present invention, both of the developing initiator and the developer replenisher contain a dihydroxybenzene developing agent and an auxiliary developing agent exhibiting a superadditive property to the developing agent.

Examples of the dihydroxybenzene developing agent for use in the present invention include hydroquinone, chlorohydroquinone, isopropylhydroquinone, methylhydroquinone, and hydroquinone monosulfonate, with hydroquinone being particularly preferable.

Examples of the auxiliary developing agent exhibiting a superadditive property to the dihydroxybenzene developing agent include 1-phenyl-3-pyrazolidones and p-aminophenols. Accordingly, in the present invention, the combination of a dihydroxybenzene developing agent with 1-phenyl-3-pyrazolidone and the combination of a dihydroxybenzene developing agent with p-aminophenol are preferably used.

Examples of the 1-phenyl-3-pyrazolidone or its derivative developing agents include 1-phenyl-3-pyrazolidone, 1-phenyl-4,4-dimethyl-3-pyrazolidone, and 1-phenyl-4-methyl-4-hydroxymethyl-3-pyrazolidone.

Examples of the p-aminophenol developing agents which can be used in the present invention include N-methyl-p-aminophenol, p-aminophenol, N-(β-hydroxyethyl)-p-aminophenol, and N-(4-hydroxyphenyl)glycine. Among these, N-methyl-p-aminophenol is particularly preferred.

The dihydroxybenzene developing agent is preferably used in an amount of from 0.05 to 0.8 mol/l, but in the present invention, it is particularly preferable to be used in an amount of 0.23 mol/l or more. More preferably, it is used in an amount of from 0.23 to 0.6 mol/l.

In the combination of a dihydroxybenzene developing agent with 1-phenyl-3-pyrazolidone or the combination of a dihydroxybenzene developing agent with p-aminophenol, the former (developing agent) is preferably used in an amount of from 0.23 to 0.6 mol/l, more preferably from 0.23 to 0.5 mol/l, and the latter is preferably used in an amount of 0.06 mol/l or less, more preferably from 0.003 to 0.03 mol/l.

In the present invention, both of the developing initiator and the developer replenisher are required to exhibit such a property that an increase of the pH when 0.1 mol of sodium hydroxide is added to 1 liter of these liquids is 0.25 or less. As a method for confirming the developing initiator or the developer replenisher to be used to have such a property, it is preferable to adjust the pH of a developing initiator or the developer replenisher to be used to 10.5, to add 0.1 mol of sodium hydroxide to 1 liter of the liquid to be tested and to measure the pH at this time. If the increase of the pH is 0.25 or less, the liquid is evaluated to have the above defined property. In the present invention, it is particularly preferable to use a developing initiator and a developer replenisher whose pH increase determined by this test is 0.2 or less.

As the method of imparting the above property to the developing initiator and developer replenisher, it is preferable to add a buffer. As the buffer, carbonates, boric acid described in JP-A-62-186259, saccharides (e.g., sucrose), oximes (e.g., acetoxime), phenols (e.g., 5-sulfosalicylic acid), tribasic phosphates (e.g., sodium salt and potassium salt thereof) are used, with carbonates and boric acid being preferably used. The amount of the buffer, particularly that of a salt of carbonic acid (carbonate), is preferably 0.5 mol/l or more, more preferably from 0.5 to 1.5 mol/l.

In the present invention, the pH of the developing initiator is from 9.5 to less than 11.0, and, particularly from 9.8 to 10.7. The pH of the developer replenisher and the pH of the developer in the developing tank during the course of developing are also within this range.

Alkali agents which can be used for setting the pH include usual water-soluble inorganic alkali metal salts (e.g., sodium hydroxide, potassium hydroxide, sodium carbonate, potassium carbonate).

When one square meter of the silver halide photographic material is developed, the amount of the developer replenisher is 225 ml or less, preferably from 30 to 225 ml, and particularly preferably from 50 to 180 ml.

The developer replenisher may have the same composition as that of the developing initiator or may contain components which are replenished in the course of developing in higher amounts than those of the initiator.

The developer in the course of developing the photographic material according to the present invention (the developing initiator and the developer replenisher are totally referred to as a developer; this is repeated to be following) may contain additives which are usually utilized (e.g., preservatives, chelating agents).

Examples of the preservatives for use in the present invention include sodium sulfite, potassium sulfite, lithium sulfite, ammonium sulfite, sodium bisulfite, sodium metasulfite, and formaldehyde-sodium bisulfite. The sulfite (free sulfite ion) is used in an amount of 0.20 mol/l or more, and preferably 0.30 mol/l or more, but if it is added too excessively, there is a cause for silver staining in the developer. Accordingly, the upper limit is preferably 1.2 mol/l. The amount is more preferably from 0.35 to 0.7 mol/l.

In combination with the sulfite, a small amount of an ascorbic acid derivative may be added as a preservative for the dihydroxybenzene developing agent (preferably 0.3 to 1.2 mol/l). The term "ascorbic acid derivative" intended herein include ascorbic acid, erythorbic acid, which is a stereo isomer of ascorbic acid, and these alkali metal salts (e.g., sodium salts, potassium salts). Preference is given to the use of sodium erythorbate in terms of the cost for material. The concentration ratio of the addition amount thereof to the amount of the dihydroxybenzene developing agent by mol is preferably from 0.03/1 to 0.12/1, more preferably from 0.05/1 to 0.10/1. In using the ascorbic derivative as a preservative, it is preferable to contain no boron compound in the developer.

Examples of additives added to the developer of the present invention include a development inhibitor (e.g., sodium bromide, potassium bromide), an organic solvent (e.g., ethylene glycol, diethylene glycol, triethylene glycol, dimethylformamide), an alkanolamine (e.g., diethanolamine, triethanolamine), a development accelerator (e.g., imidazol, derivatives thereof), and an antifoggant or black pepper (black spot) inhibitor (e.g., mercapto compound, indazole compound, benzotriazole compound, benzimidazole compound). Specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, 5-amino-1,3,4-thiadiazole-2-thiol, methylbenzotriazole, 5-methylbenzotriazole and 2-mercaptobenzotriazole. The addition amount of the antifoggant is from 0.01 to 10 mmol, more preferably from 0.05 to 2 mmol, per liter of the developer.

Further, various kinds of organic and inorganic chelating agents can be used in combination in the developer of the present invention. Examples of the inorganic chelating agents include sodium tetrapolyphosphate and sodium hexametaphosphate.

Examples of the organic chelating agents include organic carboxylic acid, aminopolycarboxylic acid, organic phosphonic acid, aminophosphonic acid, and organic phosphonocarboxylic acid.

Examples of the organic carboxylic acids include acrylic acid, oxalic acid, malonic acid, succinic acid, glutaric acid, adipic acid, pimelic acid, suberic acid, acielaidic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acids include iminodiacetic acid, nitrilotriacetic acid, nitrilotripropionic acid, ethylenediaminomonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminotetraacetic acid, and compounds disclosed in JP-A-52-25632, JP-A-55-67747, JP-A-57-102624, and JP-B-53-40900.

Examples of the organic phosphonic acids include hydroxyalkylidene-diphosphonic acid disclosed in U.S. Pat. Nos. 3,214,454, 3,794,591 and German Patent Publication No. 2,227,639, and the compounds disclosed in *Research Disclosure*, Vol. 181, Item 18170 (May, 1979).

Examples of the aminophosphonic acids include aminotris(methylenephosphonic acid), ethylenediaminotetramethylenephosphonic acid, aminotrimethylenephosphonic acid, and the compounds disclosed in *Research Disclosure*, No. 18170, JP-A-57-208554, JP-A-54-61125, JP-A-55-29883 and JP-A-56-97347.

Examples of the organic phosphonocarboxylic acids include the compounds disclosed in JP-A-52-102726, JP-A-53-42730, JP-A-54-121127, JP-A-55-4024, JP-A-55-4025, JP-A-55-126241, JP-A-55-65955, and *Research Disclosure*, No. 18170.

These chelating agents may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developer.

Furthermore, the developer for use in the present invention can contain the compounds disclosed in JP-A-56-24347, JP-B-56-46585, JP-B-62-2849, and JP-A-4-362942 as a silver stain inhibitor.

Also, the developer for use in the present invention can contain the compounds disclosed in JP-A-62-212651 as a development unevenness inhibitor, and the compounds disclosed in JP-A-61-267759 as a dissolving aid.

Moreover, the developer may contain a color toning agent, a surfactant, an antifoaming agent, and a hardener, if needed.

The development processing temperature and the development processing time are related reciprocally and determined in relationship with the total processing time, and generally the processing temperature is from about 20° to 50° C., preferably from 25° to 45° C., and the processing time is from 10 seconds to 2 minutes, preferably from 7 seconds to one minute and 30 seconds.

Preferably, the processing solution is concentrated for preservation and is diluted when it is used in order to save the transportation cost, package material cost and spaces. The salt component contained in the developer is preferably a potassium salt to concentrate the developer.

The fixing solution for use in the fixing step in the present invention is an aqueous solution containing sodium thiosulfate and ammonium thiosulfate, and if needed, tartaric acid, citric acid, gluconic acid, boric acid, iminodiacetic acid, 5-sulfosalicylic acid, glucohepatnic acid, Tiron, ethylenediamine tertaacetic acid, diethylenetriamine pentaacetic acid, nitrilo triacetic acid, and salts thereof. However, it is preferred that the boric acid is not contained in view of the environmental preservation.

Examples of the fixing agent in the fixing solution for use in the present invention include sodium thiosulfate and ammonium thiosulfate. The sodium thiosulfate is preferred in view of the fixing velocity and the sodium thioammonium is preferred in view of the environmental preservation. The amount added of the fixing agent is not particularly limited, but is generally from about 0.1 to 2 mol/l, and particularly preferably from 0.2 to 1.5 mol/l.

The fixing solution can include, if needed, a hardening agent (e.g., water-soluble aluminum compound), a preservative (e.g., sulfite, bisulfite), a pH buffer (e.g., acetic acid), a pH adjustor (e.g., ammonia, sulfuric acid), a chelating agent a surfactant, a wetting agent, and a fixing accelerator.

Examples of the surfactant include an anionic surfactant (e.g., sulfated product, sulfonated product), a polyethylene surfactant, and amphoteric surfactants disclosed in JP-A-57-6840, and known defoaming agents can also be used. Examples of the wetting agent include alkanolamine and alkylene glycol. Examples of the fixing accelerator include thiourea derivatives disclosed in JP-B-45-35754, JP-B-58-122535 and JP-B- 58-122536, alcohol having a triple bond in the molecule, thioether compounds disclosed in U.S. Pat. No. 4,126,459, mesoionic compounds disclosed in JP-A-4-229860, and compounds disclosed in JP-A-2-44355.

Examples of the pH buffer for use in the fixing solution include an organic acid such as acetic acid, malic acid, succinic acid, tartaric acid, citric acid, maleic acid, glycol acid and adipic acid, an inorganic acid such as boric acid, phosphate and sulfite. Among these, preferred are acetic acid, tartaric acid, and sulfite.

The pH buffer is used so as to inhibit the pH increase of the fixing solution by incorporation of the developer. The pH buffer is used in an amount of from 0.01 to 1.0 mol/l, preferably from 0.02 to 0.6 mol/l.

The pH of the fixing solution is preferably from 4.0 to 6.5, more preferably from 4.5 to 6.0.

As a dye dissolution accelerator, the compounds disclosed in JP-A-64-4739 can be used.

As a hardener in the fixing solution for use in the present invention, water-soluble aluminum salts and chromium salts are used. The water-soluble ammonium salt is preferred and examples thereof include aluminum chloride, aluminum sulfate and potassium alum. The amount added of the pH buffer is preferably from 0.01 to 0.2 mol, more preferably from 0.03 to 0.08 mol, per liter of the fixing solution.

The fixing temperature is from about 20° to 50° C., preferably from 25° to 45° C.; and the fixing time is from 5 seconds to one minute, preferably from 7 to 50 seconds.

The replenishing amount of the fixing solution is preferably 600 ml or less, more preferably 500 ml or less, per $m^2$ of the processed photographic material.

In the photographic processing method of the present invention, the photographic material is processed with washing water or a stabilizing solution after the development and fixation steps, and then dried. It is possible to perform the washing or stabilizing step using washing water or a stabilizing solution at a replenishment rate of at most 3 liter of a replenisher per $m^2$ of silver halide photographic material (including the replenishment rate of zero, namely the washing with stored water). That is, not only economizing water in the washing step but also making a piping work unnecessary in setting up an automatic developing machine becomes possible.

As a method for reduction in replenishment of washing water, the multistage (e.g., two-stage, three-stage) counter current process has been known for a long time. If this process is applied to the present invention, the fixation-processed photographic material is processed as it is brought into contact with successive, more and more cleaned processing solutions, that is, processing solutions less and less contaminated with the fixer. Accordingly, more efficient washing can be carried out.

When the washing step is performed with a small amount of water, it is preferable to use a washing tank equipped with squeeze rollers or crossover rollers, as disclosed in JP-A-63-18350 and JP-A-62-287252. Further, the addition of various kinds of oxidizing agents and the filtration may be supplemented for the purpose of reduction in pollution load. An increase in pollution load is a big problem that the washing with little water faces.

In the present invention also, part or all of the overflow generated from the washing or stabilizing bath by replenishing the bath with the water, which is rendered moldproof by the above-cited means, in proportion as the processing proceeds can be used in the prior step wherein the processing solution having a fixability is used, as described in JP-A-60-235133.

Moreover, a water-soluble surfactant or a defoaming agent may be included in washing water to prevent generation of irregular foaming which is liable to generate when washing is conducted with a small amount of water and/or to prevent components of the processing agents adhered to a squeegee roller from transferring to the processed film.

In addition, dye adsorbents disclosed in JP-A-63-163456 may be included in a washing tank to inhibit contamination by dyes dissolved from photographic materials.

When a photographic material is subjected to stabilizing processing after the washing processing, bath containing compounds disclosed in JP-A-2-201357, JP-A-2-132435, JP-A-1-102553 and JP-A-46-44446 may be used as a final bath. This stabilizing bath may contain, if needed, ammonium compounds, metal compounds such as Bi and Al, brightening agents, various kinds of chelating agents, film pH adjustors, hardening agents, sterilizers, antimold agents, alkanolamines, and surfactants. Tap water, deionized water, and water sterilized by a halogen, ultraviolet sterilizing lamp or various oxidizing agents (e.g., ozone, hydrogen peroxide, chlorate) or tap water containing the compounds disclosed in JP-A-4-39652 and JP-A-5-241309 are preferably used as washing water in a washing step or a stabilizing step.

The temperature and time of the washing and stabilizing bath processing are preferably from 0° to 50° C. and from 5 seconds and 2 minutes.

The processing solution used in the present invention is preferably stored in a package material slightly pervious to oxygen as disclosed in JP-A-61-73147.

The processing solution for use in the present invention may form a powder agent or a solid material. The formation may be carried out by known methods, and the methods disclosed in JP-A-61-259921, JP-A-4-85533 and JP-A-16841 are preferred, and the method disclosed in JP-A-61-2559921 is particularly preferred.

When the replenishing amount is lowered, the evaporation and air oxidation of the solution are inhibited by reducing the contact area of the solution and the air of the solution tank. Automatic developing machines of roller conveyance type are described in, e.g., U.S. Pat. Nos. 3,025,779 and 3,545,971, and the present invention refers them to simply as processors of roller conveyance type. A processor of roller conveyance type involves four processes, namely development, fixation, washing and drying processes. Also, it is most advantageous for the present method to follow those four processes, although the present method does not exclude other processes (e.g., stop process). The four processes may contain a stabilizing step in place of the washing step.

The components in which water is removed from the compositions of the developer or fixer may be provided as a solid, and the solid may be dissolved in water to be ready for use for the developer or fixer. The processing agent in such a form is called a solid-form processing agent (solid processing agent). The solid-form processing agent in the form of powder, tablet, granule, mass or paste may be used. A preferred form is a form as described in JP-A-61-259921 or a tablet form. The tablet can be produced by a general process, for example, as described in JP-A-51-61837, JP-A-54-155038, JP-A-52-88025, U.K. Patent No. 1,213,808, or the like. The granule may be produced by a general process, for example, as described in JP-A-2-109042, JP-A-2-109043, JP-A-3-39735, JP-A-3-39739, or the like. Moreover, the power processing agent may be produced by a general process, for example, as described in U.K. patent Nos. 725,892 and 729,862, German patent No. 3,733,861, or the like.

The bulk density of the solid-form processing agent is preferably in the range of from 0.5 to 6.0 g/cm$^3$, and particularly from 1.0 to 5.0 g/cm$^3$, from the viewpoints of the solubility and the object of the present invention.

The solid-form processing agent may be a solid processing agent, wherein the solid processing agent contains at least two mutually reactive granular substances; the two mutually reactive granular substances are separated by at least one intercalary separation layer containing an inert substance to the two mutually reactive substances; a bag which can be vacuum-packed is used as a coating material; the air in the bag is exhausted; and the exhausted bag is sealed. In this case, the term "inert" means the state where when the substances are physically brought in contact with each other, they are not reacted under normal conditions or no marked reaction occurs even if any reaction occurs. Apart from the fact that the inert substance is inert to the two mutually reactive substances, the inert substance may be inert in the intended use of the two reactive substances. Furthermore, it is a substance which can be simultaneously used together with two mutually reactive substances. For instance, hydroquinone and sodium hydroxide are reacted with each other when they are bought in contact with each other. By using sodium sulfite as a layer for separating hydroquinone and sodium hydroxide, it is possible to store the solid-form processing agent in a package over a prolonged period. Inert plastic films, bags made of a laminate of a plastic substance a metal foil are used as packaging materials for vacuum packaging.

The photographic materials of the present invention are not particularly restricted as to additives, and so various kinds of additives can be used therein. However, those disclosed in the following patent specifications can be preferably added thereto.

| Item | Reference and Passage therein |
|---|---|
| 1) Surfactants and Antistatic agents | JP-A-2-12236, at page 9, from right upper column, line 7, to right lower column, line 7; and JP-A-2-185424, from page 2, left lower column, line 13, to page 4, right lower column, line 18. |
| 2) Antifoggants and Stabilizers | JP-A-2-103536, from page 17, right lower column, line 19, to page 18, right upper column, line 4, and page 18, right lower column, from line 1 to line 5; the thiosulfinic acid compounds disclosed in JP-A-1-237538. |
| 3) Polymer latexes | JP-A-2-103536, page 18, left lower column, from line 6 to line 20. |

-continued

| Item | Reference and Passage therein |
|---|---|
| 4) Compounds containing an acidic group | JP-A-2-103536, from page 18, left lower column, line 6, to page 19, left upper column, line 1. |
| 5) Matting agents, Slipping agents, and Plasticizers | JP-A-2-103536, at page 19, from left upper column, line 15, to right upper column, line 15. |
| 6) Hardeners | JP-A-2-103536, at page 18, right upper column, from line 5 to line 17. |
| 7) Dyes | JP-A-2-103536, at page 17, right lower column, from line 1 to line 18; the solid dyes disclosed in JP-A-2-294638 and JP-A-5-11382. |
| 8) Binders | JP-A-2-18542, at page 3, right lower column, from line 1 to line 20. |
| 9) Black spot inhibitors | The compounds disclosed in U.S. Pat. No. 4,956,257 and JP-A-1-118832. |
| 10) Monomethine compounds | The compounds represented by formula (II) in JP-A-2-287532 (especially Exemplified Compounds II-1 to II-26). |
| 11) Dihydroxybenzenes | The compounds disclosed in JP-A-3-39948, from page 11, left upper column to page 12, left lower column, and those disclosed in EP-A-452772. |
| 12) Spectral sensitizing dyes | Spectral sensitizing dyes disclosed in JP-A-2-12236, from page 8, left lower column, line 13 to right lower column, line 4; JP-A-2-103536, from page 16, right lower column, line 3 to page 17, left lower column, line 20; JP-A-1-112235; JP-A-2-124560; JP-A-3-7928; and JP-A-5-11389. |
| 13) Nucleation accelerators | The compounds represented by formulae (I), (II), (III), (IV), (V) and (VI) disclosed in JP-A-6-82943; the compounds represented by formulae (II-m) to (II-p), and Exemplified Compounds II-1 to II-22, disclosed in JP-A-2-103536, from page 9, right upper column, line 13, to page 16, left upper column, line 10; the compounds disclosed in JP-A-1-179939. |
| 14) Redox compounds | The compounds represented by formula (I) disclosed in JP-A-2-301743 (especially Compounds 1 to 50); the compounds represented by formulae (R-1), (R-2) and (R-3), Exemplified Compounds 1 to 75, disclosed at pages 3 to 20 in JP-A-3-174143; the compounds disclosed in JP-A-5-257239 and JP-A-4-278939. |

The present invention will now be illustrated in greater detail by reference to the following examples. However, the invention should not be construed as being limited to these examples.

EXAMPLES 1-1 AND 1-2

First, silver halide emulsions used in the following examples will be explained.

Emulsion Al

An aqueous 0.13M silver nitrate solution and an aqueous halide solution containing $K_2Rh(H_2O)Cl_5$ in an amount corresponding to $1.5\times10^{-7}$ mol per mol of silver, $K_3IrCl_6$ in an amount of $2\times10^{-7}$ mol per mol of silver, 0.04M potassium bromide and 0.09M sodium chloride were added to an aqueous gelatine solution containing sodium chloride and 1,3-dimethyl-2-imidazolidinethione with stirring at 38° C. over a period of 12 minutes according to a double jet method for nucleating. Silver chlorobromide particles having an average particle size of 0.14 μm and a silver chloride content of 70 mol %. Subsequently, an aqueous 0.87M silver nitrate solution and an aqueous halide solution containing 0.26M potassium bromide and 0.65M sodium chloride were similarly added according to the double jet method over a period of 20 minutes.

Thereafter, a $1\times10^{-3}$ mol KI solution was added for conversion, and the solution was washed with water by a flocculation method according to the conventional method using a copolymer of isobutene and monosodium salt of maleic acid as a sedimentation agent. Then, 40 g of gelatin was added per mol of silver, and the pH and the pAg were adjusted to 6.5 and 7.5, respectively. Then, 7 mg of sodium benzenethiosulfonate, 2 mg of benzenesulfinate, 8 mg of chloroauric acid, 200 mg of potassium thiocyanate, and 5 mg of sodium thiosulfate were added per mol of silver, the mixture was heated at 60° C. for 45 minutes for chemical sensitization. Thereafter, 150 mg of 4-hydroxy-6-methyl-1,3,3a,7-tetrazaindene as a stabilizer and 100 mg of proxel as a preservative were added. The resulting particles were silver iodochlorobromide cubes having an average particle size of 0.25 μm and containing 69.9 mol % of silver halide. (coefficient of variation: 10%).

Emulsion B1

An aqueous 0.37 mol silver nitrate solution and an aqueous halide solution containing $(NH_4)_3RhCl_6$ in an amount corresponding to $1.0\times10^{-7}$ mol per mol of silver in the finished emulsion, $K_3IrCl_6$ in an amount of $2\times10^{-7}$ mol per mol of silver, 0.11 mol potassium bromide and 0.27 mol sodium chloride were added to an aqueous gelatine solution containing sodium chloride and 1,3-dimethyl-2-imidazolidinethione with stirring at 45° C. over a period of 12 minutes according to the double jet method for nucleating. Silver chlorobromide particles having an average particle size of 0.20 μm and a silver chloride content of 70 mol %. Subsequently, an aqueous 0.63 mol silver nitrate solution and an aqueous halide solution containing 0.19 mol potassium bromide and 0.47 mol sodium chloride were similarly added according to the double jet method over a period of 20 minutes. Thereafter, a $1\times10^{-3}$ mol KI solution was added per mol of silver for conversion, and the solution was washed with water by a flocculation method according to the conventional method. Then, 40 g of gelatin was added, and then the pH and the pAg were adjusted to 6.5 and 7.5, respectively. Then, 7 mg of sodium benzenesulfonate, 5 mg of sodium thiosulfate, and 8 mg of chloroauric acid were added, the mixture was heated at 60° C. for 45 minutes for chemical sensitization. Thereafter, 150 mg of 4-hydroxy-6-methyl-1,3,3a,7-tetrazaindene as a stabilizer and proxel as a preservative were added. The resulting particles were silver chlorobromide cubes having an average particle size of 0.28 μm and containing 70 mol % of silver halide. (coefficient of variation: 9%).

Emulsion C1

With stirring, Liquid 1, Liquid 2 and Liquid 3 described in Table 1, kept at 38° C. and at a pH of 4.5 were added at the same time over a period of 24 minutes to form 0.18 μm particles. Subsequently, Liquid 4 and Liquid 5 were added over a period of 8 minutes, and 0.15 g of potassium chloride was added to finish the formation of particles.

Thereafter, the particles were washed with water by the flocculation method according to the usual method, gelatine was added, and the pH and the pAg were adjusted to 5.2 and 7.5, respectively, followed by adding 4 mg of sodium thiosulfate, 2 mg of N,N-dimethylselenourea, 10 mg of chloroauric acid, 4 mg of sodium benzenethiosulfonate, and 1 mg of sodium benzenethiosulfinate to be chemically sensitized so as to reach the optimum sensitivity at 55° C.

Furthermore, 50 mg of 2-methyl-4-hydroxy-1,3,3a,7-tetrazaindene as a stabilizer and phenoxy ethanol as a preservative in a concentration of 100 ppm were added to finally obtain silver iodochlorobromide cubic particles containing 80 mol % of silver chloride and having an average particle size of 0.20 μm. (Coefficient of variation: 9%).

TABLE 1

| | |
|---|---|
| Liquid 1: | |
| Water | 1 liter |
| Gelatin | 20 g |
| Sodium chloride | 2 g |
| 1,3-Dimethylimidazolidin-2-thion | 20 mg |
| Sodium benzenethiosulfonate | 6 mg |
| Liquid 2: | |
| Water | 600 ml |
| Silver nitrate | 150 g |
| Liquid 3: | |
| Water | 600 ml |
| Sodium chloride | 45 g |
| Potassium bromide | 21 g |
| Potassium hexachloroiridinate (III) (Aqueous 0.001% solution) | 15 ml |
| Ammonium hexabromoiridinate (III) (Aqueous 0.001% solution) | 1.5 ml |
| Liquid 4: | |
| Water | 200 ml |
| Silver nitrate | 50 g |
| Liquid 5: | |
| Water | 200 ml |
| Sodium chloride | 15 g |
| Potassium bromide | 7 g |
| $K_4Fe(CN)_6$ | 30 mg |

EXAMPLE 1-1

Onto a polyethylene terephthalate film (150 μm) support having an undercoating layer (0.5 μm) comprising a vinylidene chloride copolymer, layers of UL, EM, ML and PC were applied in this order from the support. The preparation and the applied amount of each layer are shown below.

(UL Layer)

Gelatin (10 g), 50 wt % of polyethylacrylate latex based on gelatin, and 3.5 wt % of hardening compound (a) based on gelatine were added and an amount of water such that the total amount was 250 ml was added to prepare a UL layer, which was applied so that the amount of gelatine was 0.4 g/m$^2$.

(EM Layer)

After the above-mentioned Emulsion A was dissolved with gelatine at 40° C., $3.2\times10^{-4}$ mol/mol Ag of sensitizer (the above-mentioned S5-9), $2.7\times10^{-4}$ mol/mol Ag of sensitizing dye (S-1), $3.4\times10^{-3}$ mol/mol Ag of KBr, $3.2\times10^{-4}$ mol/mol Ag of compound (b), $7.4\times10^{-4}$ mol/mol Ag of compound (c), $9.7\times10^{-3}$ mol/mol Ag of hydroquinone, $8.0\times10^{-3}$ mol/mol Ag of phosphoric acid, $4.5\times10^{-4}$ mol/mol Ag of compound (I-38) represented by formula (I), $5.3\times10^{-4}$ mol/mol Ag of compound (A-12) represented by formula (II), and $3\times10^{-4}$ mol/mol Ag of compound W-1 were added. Further, 15 wt % of polyethyl acrylate, 15 wt % of a latex copolymer (methyl acrylate:sodium 2-acrylamido-2-methylpropane sulfonate:2-acetoacetoxyethyl methacrylate=88:5:7; weight ratio), and 4 wt % of compound (a) were added all based on gelatine, and the mixture was applied so that the amount of Ag was 3.3 g/m$^2$.

(ML Layer)

To a gelatine solution were added 7 mg/m$^2$ of compound (d), 15 wt % of polyethyl acrylate, and 3.5 wt % of compound (a), all based on gelatine, and the mixture was applied so that the amount of gelatine was 0.5 g/m$^2$.

(PC Layer)

To a gelatine solution were added 40 mg/m$^2$ of an amorphous matting agent having an average particle size of 3.5 μm, 20 mg/m$^2$ of silicone oil, and 5 mg/m$^2$ of compound (e) as an applying aid, and the mixture was applied. The amount of gelatine was 0.3 g/m$^2$.

Additives to Photographic Material of Example 1-1:

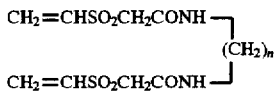

Compound (a)

3:1 mixture of compounds wherein n=2 and wherein n=3

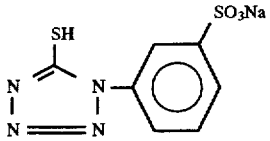

Compound (b)

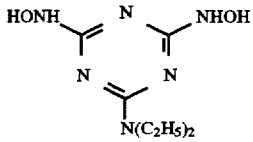

Compound (c)

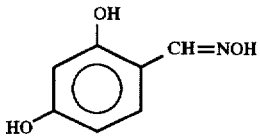

Compound (d)

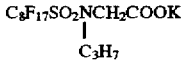

Compound (e)

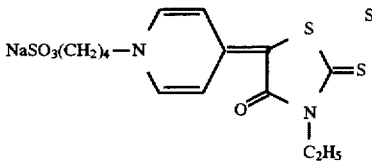

Sensitizing Dye (S-1)

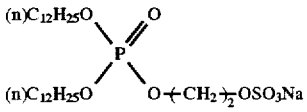

Compound W-1

A backing layer and a back protective layer having the following formulations were applied:

[Formulation of Backing Layer]

| | |
|---|---|
| Gelatin | 3 g/m$^2$ |
| Latex: Polyethyl acrylate | 2 g/m$^2$ |
| Surfactant: Sodium p-Dodecylbenzenesulfonate | 40 mg/m$^2$ |
| Compound (a) | 110 mg/m$^2$ |
| $SnO_2$/Sb (weight ratio 90/10, | 200 mg/m$^2$ |

-continued

| | |
|---|---|
| average particle size: 0.20 μm) | |
| Dyestuff: | |
| Mixture of Dyestuff ($a_1$), Dyestuff ($b_1$), and Dyestuff ($c_1$) | |
| Dyestuff ($a_1$) | 70 mg/m$^2$ |
| Dyestuff ($b_1$) | 100 mg/m$^2$ |
| Dyestuff ($c_1$) | 50 mg/m$^2$ |

Dyestuff ($a_1$)

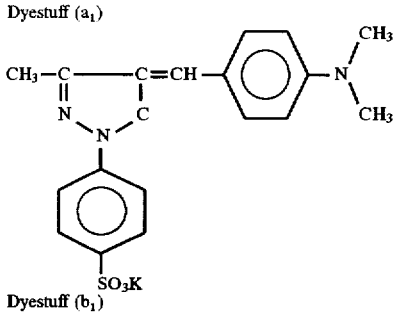

Dyestuff ($b_1$)

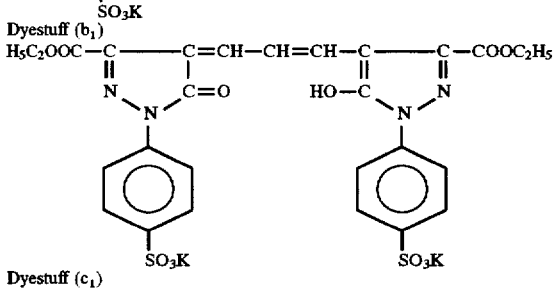

Dyestuff ($c_1$)

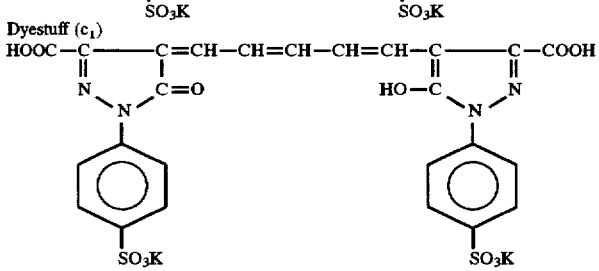

[Back Protective Layer]

| | |
|---|---|
| Gelatin | 0.8 mg/m$^2$ |
| Polymethyl methacrylate fine particle (average particle size: 4.5 μm) | 30 mg/m$^2$ |
| Sodium dihexyl-α-sulfosuccinate | 15 mg/m$^2$ |
| Sodium p-dodecylbenzenesulfonate | 15 mg/m$^2$ |
| Sodium acetate | 40 mg/m$^2$ |

Using formulation as shown in Table 2, developers were prepared.

TABLE 2

Composition of Developer

| Developer components | Developer No. and Composition (g) D1-1 | D1-2 | D1-3 | D1-4 |
|---|---|---|---|---|
| Potassium hydroxide | 35 | " | " | " |
| Diethylene triamine pentaacetate | 2.0 | " | " | " |
| Potassium carbonate | 40 | 100 | 85 | 70 |
| Potassium bromide | 3 | " | " | " |
| 5-Methylbenzotriazole | 0.08 | " | " | " |
| Sodium 2-mercaptobenz-imidazole-5-sulfonate | 0.15 | | | |

TABLE 2-continued

Composition of Developer

| Developer components | Developer No. and Composition (g) D1-1 | D1-2 | D1-3 | D1-4 |
|---|---|---|---|---|
| 2,3,5,6,7,8-Hexahydro-2-thioxo-4-(1H)-xynazoline) | 0.03 | " | " | " |
| Sodium metabisulfite | 44 | 54 | 62 | 44 |
| 4-Hydroxymethyl-4-methyl-1-phenyl-3-pyrazolidone | 0.45 | " | " | " |
| Hydroquinone | 23.3 | 30.0 | 35.0 | 23.3 |
| Sodium erythorbate | 3.0 | " | " | " |
| Water to | 1 l | " | " | " |
| pH adjusted to | 10.5 | 10.5 | 10.5 | 10.5 |
| pH increase value when 0.1 mol of NaOH is added to 1 l of the developer | 0.5 | 0.23 | 0.24 | 0.3 |
| Remarks | Comp. | Inv. | Inv. | Comp. |

The formulation of the fixer used in the present invention is shown below.

(Formulation of Fixer)

| | |
|---|---|
| Ammonium thiosulfate | 360.0 g |
| Ethylenediainine tetraacetate, 2Na.2$H_2O$ | 0.09 g |
| Sodium thiosulfate 5$H_2O$ | 33.0 g |
| Sodiuin sulfite | 75.0 g |
| Sodium hydroxide | 37.0 g |
| Glacial acetic acid | 87.0 g |
| Tartaric acid | 8.8 g |
| Sodium gluconate | 5.2 g |
| Aluminum sulfate | 25. g |
| Water | to 3 liters |
| pH (adjusted with sulfuric acid or sodium hydroxide) | 4.85 |

(Evaluation)

The applied samples were exposed through 3200° K. tungsten light using an optical wedge. These samples were subjected to a running test using FG-680A produced by Fuji Photo Film Co., Ltd. As for the running conditions, taking the continuous running where 40 sheets of half-exposed films A having a size of 50.8 cm×61.0 cm were processed per day, and this running was conducted for 6 days and suspended for 1 day as 1 round, the running was carried out 6 rounds. The amounts replenished are shown in Table 3. The processing was carried out for a developing period of 30 seconds at a temperature of 35° C.

The evaluations of photographic properties were carried out as follows. The gradation is shown as a relative value taking a value of difference between the density of 3.0 and the density of 0.3 is divided by a logarithm of the difference between an exposure a mount giving the density of 3.0 and an exposure amount giving the density of 0.3 as 100. The sensitivity is shown as a relative value taking the reciprocal number of an exposure amount giving the density of 1.5, when being processed with a fresh liquid of No. 1 in Table 1 as 100.

The silver staining was visually evaluated at five point ranks.

The state where no silver staining occurs on the film, the developing tank, and the roller at all is designated as rank 5, while the state where a large amount of silver stain occurs on the film, the developing tank, and the roller is designated as rank 1. Rank 4 is a state where no silver stain occurs on the film but a small amount of silver staining occurs on the developing tank an d the roller and is a practically allowable level. Rank 3 or less is no practical level.

The results of photographic properties according to the running experiments are shown in Table 3.

TABLE 3

| No. | Developer | Amount replenished (ml/m$^2$) | Photographic properties | Fresh liquid | Aged liquid | Silver staining | Remarks |
|---|---|---|---|---|---|---|---|
| 1-1 | D1-1 | 250 | Sensitivity | 100 | 95 | 4 | Comparison |
| | | | Gradation | 21.0 | 19.84 | | |
| | | | Fog | 0.04 | 0.04 | | |
| 1-2 | D1-2 | 250 | Sensitivity | 100 | 96 | 5 | Comparison |
| | | | Gradation | 21.02 | 20.85 | | |
| | | | Fog | 0.04 | 0.04 | | |
| 1-3 | D1-3 | 250 | Sensitivity | 100 | 98 | 5 | Comparison |
| | | | Gradation | 21.00 | 20.87 | | |
| | | | Fog | 0.04 | 0.04 | | |
| 1-4 | D1-4 | 250 | Sensitivity | 100 | 94 | 4 | Comparison |
| | | | Gradation | 21.01 | 20.28 | | |
| | | | Fog | 0.04 | 0.04 | | |
| 1-5 | D1-1 | 180 | Sensitivity | 100 | 71 | 2 | Comparison |
| | | | Gradation | 21.00 | 6.78 | | |
| | | | Fog | 0.04 | 0.04 | | |
| 1-6 | D1-2 | 180 | Sensitivity | 100 | 95 | 4 | Invention |
| | | | Gradation | 21.00 | 19.78 | | |
| | | | Fog | 0.04 | 0.04 | | |
| 1-7 | D1-3 | 180 | Sensitivity | 100 | 95 | 4 | Invention |
| | | | Gradation | 20.99 | 19.82 | | |
| | | | Fog | 0.04 | 0.04 | | |
| 1-8 | D1-4 | 180 | Sensitivity | 100 | 82 | 2 | Comparison |
| | | | Gradation | 21.01 | 10.84 | | |
| | | | Fog | 0.04 | 0.04 | | |

By the processing method using the developer according to the present invention, an ultrahigh contrast image can be stably obtained even if the processing is carried out in a low amount of the developer replenished. In addition, in the case of the processing in a low amount of the developer replenished, a large amount of silver sludge is generated in the developing tank and is transferred onto the film, but the silver staining during the running is drastically improved by using the developer according to the present invention. These effects are unexpected, and it is preferred because the running stability is enhanced and at the same time, the silver staining is improved.

EXAMPLE 1-2

Samples were prepared in the same manner as in Example 1-1, except for replacing the formulation of the EM layer in Example 1-1 with the following formulation.

(EM Layer)

After the above-mentioned Emulsion B was dissolved with gelatin at 40° C., $4.6\times10^{-4}$ mol/mol Ag of sensitizer (the above-mentioned S1-1), $1.7\times10^{-4}$ mol/mol Ag of sensitizing dye (S-1), $4.5\times10^{-3}$ mol/mol Ag of KBr, $3.1\times10^{-4}$ mol/mol Ag of compound (b), $7.4\times10^{-4}$ mol/mol Ag of compound (c), $2.9\times10^{-2}$ mol/mol Ag of hydroquinone, $2.3\times10^{-3}$ mol/mol Ag of acetic acid, 10 wt % of colloidal silica based on gelatin, $3.4\times10^{-4}$ mol/mol Ag of compound (I-38) represented by formula (I), $4.9\times10^{-4}$ mol/mol Ag of the compound (A-12) represented by formula (II), and $3.4\times10^{-4}$ mol/mol Ag of compound W-1 were added. Further, 30 wt % of polyethyl acrylate latex polymer and 4 wt % of compound (a) were added both based on gelatine, and the mixture was applied. Compounds (a), (b), (c) were the same as those of Example 1-1.

The samples thus prepared were exposed through an interference filter having a peak at 488 nm and an optical wedge for $10^{-5}$ second of emission period with xenon flush.

These samples were subjected to a running test using FG-680AG produced by Fuji Photo Film Co., Ltd. As for the running conditions, taking the continuous running where 40 sheets of half-exposed films of 20×24 inch paper (50.8 cm×61.0 cm) were processed per day, and this running was conducted for 6 days and suspended for 1 day as 1 round, the running was carried out 6 rounds.

The developer was prepared from the agents whose state of storage was a solid-form processing agent and a liquid-form processing agent. The formulations of the developers used and the states of the storage are shown in Table 4.

As for the production of the solid-form processing agent, the components of developer were layered in a solid state and packed into a bag comprising aluminum foil coated on a plastic substance. The order of the layers from up to down was as follows:

| | |
|---|---|
| 1st layer | Hydroquinone |
| 2nd layer | Other components |
| 3rd layer | Sodium bisulfite |
| 4th layer | Potassium carbonate |
| 5th layer | Potassium hydroxide pellet. |

The system was drained in the conventional manner, and the system was drawn into vacuum, and then sealed.

The liquid-form processing agent was stored in the state of a concentrated liquid having a concentration 1.5 times the liquid formulation to be used (diluting rate: 2:1).

The solid processing agent and the liquid processing agent were stored at 50° C. for 60 days, and were dissolved to be used for running.

The development was carried out for 30 seconds at a temperature of 35° C. The fixer used was GR-F1, the amount of the developer replenished was 120 ml per the total amount, and the fixation was carried out at a temperature of 37° C. The results and experimental conditions are shown in Table 5. The evaluations of photographic properties were carried out as in those of Example 1-1, and the evaluation of unevenness was carried out by printing 90% flat halftone onto a sample in 100 lines using a color scanner of an argon light source, SG 708, produced by DAINIPPON SCREEN MFG., CO., LTD., and visually evaluating the unevenness. The unevenness was evaluated by five point ranks. The rank "5" represents good and the rank "1" represents poor. The evaluation of unevenness was carried out by processing a sample after the running had been finished.

TABLE 4

Composition of Developer

| Developer components | Developer No. and Composition (g) D1-5 | D1-6 | D1-7 | D1-8 |
|---|---|---|---|---|
| Potassium hydroxide | 35 | " | " | " |
| Diethylene triamine triacetate | 2.0 | " | " | " |
| Potassium carbonate | 40 | " | 100 | " |
| Potassium bromide | 3 | " | " | " |
| 5-Methylbenzotriazole | 0.08 | " | " | " |
| Sodium 2-mercaptobenz-imidazole-5-sulfonate | 0.15 | " | " | " |
| 2,3,5,6,7,8-Hexahydro-2-thioxo-4-(1H)-xynazoline) | 0.03 | " | " | " |
| Sodium metabisulfite | 44 | " | 54 | " |
| 4-Hydroxymethyl-4-methyl-1-phenyl-3-pyrazolidone | 0.45 | " | " | " |
| Hydroquinone | 23.3 | " | 30.0 | " |
| Sodium erythorbate | 3.0 | " | " | " |
| Water to | 1 l | " | " | " |
| pH adjusted to | 10.5 | 10.5 | 10.5 | 10.5 |
| Form of the developer | liquid | solid | liquid | solid |
| pH increase value when 0.1 mol of NaOH is added to 1 l of the developer | 0.5 | 0.5 | 0.23 | 0.23 |
| Remarks | Comp. | Comp. | Inv. | Inv. |

The developer prepared from the solid-form processing agent was found to have excellent stability and less unevenness even in the processing in a low amount of the developer replenished.

From the above results, a process for processing a silver halide monochromatic photographic material using a developer having a pH of less than 11.0 which give an ultrahigh contrast image, a little silver staining even when a small amount of the developer is replenished, and can maintain stable performances of less variation of photographic properties can be provided by the present invention.

EXAMPLES 2-1 TO 2-3

Emulsion A2 shown in Table 6 was prepared in the same manner as Emulsion A1 in the above examples.

Emulsions B2 to G2 shown in Table 6 were prepared in the same manner as Emulsion A2, except that the chemical sensitization of Emulsion C2 and D2 was changed as follows. Preparation of Emulsion C2:

Emulsion C2 was prepared in the same manner as in the preparation of Emulsion A2, except for replacing the chemical sensitization conditions in the preparation of Emulsion A2 with a pH of 5.9, a pAg of 7.5, a temperature of 65° C., 2.0 mg of sodium thiosulfate, 3.0 mg of triphosphine selenide, 6 mg of chloroauric acid, 4 mg of sodium benzenethiosulfnonate, and 1 mg of sodium benzenesulfinate.

Preparation of Emulsion D2

Emulsion D2 was prepared in the same manner as in the preparation of Emulsion A2, except for replacing the chemical sensitization conditions in the preparation of Emulsion A2 with a pH of 5.9, a pAg of 7.5, a temperature of 65° C., 2.0 mg of sodium thiosulfate, 3.0 mg of triphosphine telluride, 6 mg of chloroauric acid, 4 mg of sodium benzenethiosulfnonate, and 1 mg of sodium benzenesulfinate.

TABLE 5

| No. | Developer | Amount replenished (ml/m²) | Photographic properties | Fresh liquid | Aged liquid | Silver staining | Processing unevenness | Remarks |
|---|---|---|---|---|---|---|---|---|
| 1-9 | D1-5 | 180 | Sensitivity | 100 | 75 | 2 | 2 | Comparison |
| | | | Gradation | 21.0 | 8.82 | | | |
| | | | Fog | 0.04 | 0.04 | | | |
| 1-10 | D1-6 | 180 | Sensitivity | 100 | 72 | 3 | 3 | Comparison |
| | | | Gradation | 21.02 | 7.95 | | | |
| | | | Fog | 0.04 | 0.04 | | | |
| 1-11 | D1-7 | 180 | Sensitivity | 100 | 94 | 3 | 3 | Invention |
| | | | Gradation | 21.00 | 19.87 | | | |
| | | | Fog | 0.04 | 0.04 | | | |
| 1-12 | D1-8 | 180 | Sensitivity | 100 | 93 | 5 | 5 | Invention |
| | | | Gradation | 21.01 | 19.28 | | | |
| | | | Fog | 0.04 | 0.04 | | | |

TABLE 6

| No. | Halogen composition | Rhodium or ruthenium complex: Kind | Rhodium or ruthenium complex: Position | Rhodium or ruthenium complex: Amount (mol/mol Ag) | $K_3IrCl_6$: Position of addition | $K_3IrCl_6$: Amount (mol/mol Ag) | Chemical sensitizer |
|---|---|---|---|---|---|---|---|
| A2* | $AgBr_{30}Cl_{69.9}I_{0.1}$ | $(NH_4)Rh_2(H_2O)Cl_5$ | Core | $1.5 \times 10^{-7}$ | C/S | $2 \times 10^{-7}$ | Au/S |
| B2* | $AgBr_{30}Cl_{69.9}I_{0.1}$ | $K_2Ru(NO)Cl_5$ | Core | $1.5 \times 10^{-7}$ | C/S | $2 \times 10^{-7}$ | Au/S |
| C2* | $AgBr_{30}Cl_{69.9}I_{0.1}$ | $(NH_4)Rh_2(H_2O)Cl_5$ | Core | $1.5 \times 10^{-7}$ | C/S | $2 \times 10^{-7}$ | Au/S/Se |
| D2* | $AgBr_{30}Cl_{69.9}I_{0.1}$ | $(NH_4)Rh_2(H_2O)Cl_5$ | Core | $1.5 \times 10^{-7}$ | C/S | $2 \times 10^{-7}$ | Au/S/Te |
| E2 | $AgBr_{30}Cl_{69.9}I_{0.1}$ | $(NH_4)Rh_2(H_2O)Cl_5$ | C/S | $1.5 \times 10^{-7}$ | C/S | $2 \times 10^{-7}$ | Au/S |
| F2 | $AgBr_{30}Cl_{69.9}I_{0.1}$ | $(NH_4)Rh_2(H_2O)Cl_5$ | Core | $1.7 \times 10^{-7}$ | C/S | $2 \times 10^{-7}$ | Au/S |
| G2 | $AgBr_{30}Cl_{69.9}I_{0.1}$ | — | — | — | C/S | $2 \times 10^{-7}$ | Au/s |

*The present invention

Production of applying sample

To the above emulsion were added $3\times10^{-4}$ mol of the mercapto compound represented by the following formula (a), $4\times10^{-4}$ mol of the mercapto compound represented by the following formula (b), $4\times10^{-4}$ mol of the triazine compound represented by the following formula (c), and $2\times10^{-3}$ mol of 5-chloro-8-hydroxyquinoline all per mol of silver as well as $5\times10^{-4}$ mol and $1\times10^{-4}$ mol of hydrazine derivatives (I-37) and (I-47) according to the present invention both per mol of silver, respectively. Furthermore, 30 mg/m$^2$ of sodium salt of N-oleyl-N-methyltaurine, 200 mg/m$^2$ of colloidal silica, and 200 mg/m$^2$ of a dispersion of nucleating accelerators represented by the following formulae and polyethyl acrylate were added, and then 200 mg/m$^2$ of 1,3-divinylsulfonyl-2-propanol was added as a hardener. The pH of the solution was adjusted to 6.0. This was applied on a vinylidene chloride primer-coated polyethylene terephthalate film in such an amount that the amount of Ag was 3.0 g/m$^2$ (the gelatine amount: 1.5 g/m$^2$).

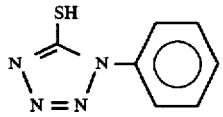

(a)

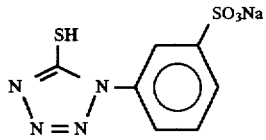

(b)

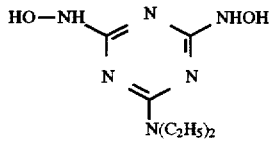

(c)

Nucleating accelerator-1

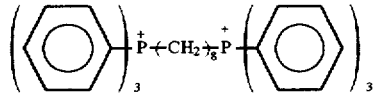

10 mg/m$^2$

Nucleating accelerator-2

-continued

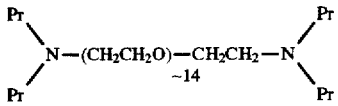

10 mg/m$^2$

On the emulsion layer, 0.5 g/m$^2$ of gelatine, 40 mg/m$^2$ of an amorphous $SiO_2$ matting agent having an average particle size of about 3.5 μm, 50 mg/m$^2$ of silicone oil, 80 mg/m$^2$ of colloidal silica and 5 mg of a fluorine type surfactant represented by the following formula ($d_2$) and 100 mg/m$^2$ of sodium dodecylbenzenesulfonate as applying aids as an upper protective layer and 0.8 g of gelatine, 400 mg/m$^2$ of ethyl acrylate latex, and 200 mg/m$^2$ of hydroquinone as a lower protective layer were added to prepare a sample as shown in Table 7.

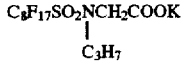

($d_2$)

A backing layer and a back protective layer having the following formulations were applied:

[Formulation of Backing Layer]

| | |
|---|---|
| Gelatin | 3 g/m$^2$ |
| Latex: Polyethyl acrylate | 2 g/m$^2$ |
| Surfactant: Sodium p-dodecylbenzenesulfonate | 40 mg/m$^2$ |
| Compound (a) | 110 mg/m$^2$ |
| 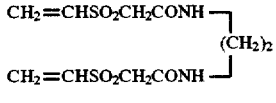 | |
| $SnO_2$/Sb (weight ratio 90/10, average particle size: 0.20 μm) | 200 mg/m$^2$ |
| Dyestuff: Mixture of Dyestuff ($a_2$), Dyestuff ($b_2$), and Dyestuff ($c_2$) | |
| Dyestuff ($a_2$) | 50 mg/m$^2$ |
| Dyestuff ($b_2$) | 100 mg/m$^2$ |
| Dyestuff ($c_2$) | 50 mg/m$^2$ |

-continued

Dyestuff ($a_2$)

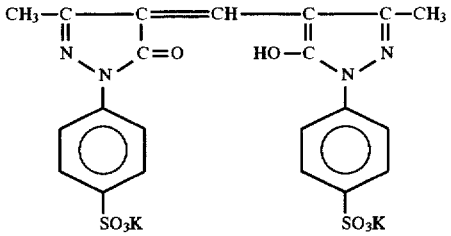

Dyestuff ($b_2$)

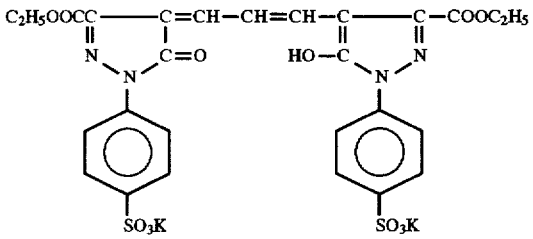

Dyestuff ($c_2$)

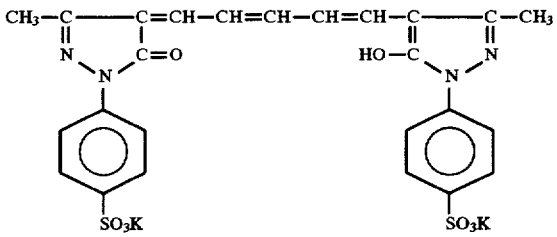

-continued

| | |
|---|---|
| Sodium p-dodecylbenzenesulfonate | 15 mg/m$^2$ |
| Sodium acetate | 40 mg/m$^2$ |

EXAMPLE 2-1

With regard to the samples produced in the above process, while reducing the amount of the developer replenished, running tests were carried out and the performances were compared with those of a new liquid (photographic properties 1). The results are shown in Table 7. As is clear from Table 7, the combinations according to the present invention (Sample Nos. 2-8 to 2-12) had low changes of the sensitivity and gradation, and showed good results.

The evaluations were carried out as follows:

(Photographic properties 1)

The sample thus obtained was exposed through a step wedge with a tungsten light, and developed using a developer having a formulation as shown in Table 8 as a developer and GR-F1 (produced by Fuji Photo Film Co., Ltd.) as a fixer with FG-680A automatic developing machine (produced by FUJI FILM Co., Ltd.) at 35° C. for 30 seconds. The results of evaluations are shown in Table 7.

The sensitivity is shown as a relative value relative to the reciprocal number of an exposure amount required giving the density of 1.5 in the development at 35° C. for 30 seconds. The γ value is represented by the following formula:

$$\gamma = \frac{3.0 - 0.3}{\log(\text{exposure amount giving the density of } 3.0) - \log(\text{exposure amount giving the density of } 0.3)}$$

TABLE 7

| | | | Photographic properties 1 | | Photographic properties 2 | | Photographic properties 3 | |
|---|---|---|---|---|---|---|---|---|
| No. | Emulsion | Developer | Sensitivity | Gradation | Sensitivity | Gradation | Sensitivity | Gradation |
| 2-1 | A | D2-1 | 100 | 19.0 | 100 | 18.8 | 85 | 12.0 |
| 2-2 | B | " | 98 | 19.1 | 98 | 19.0 | 81 | 12.2 |
| 2-3 | C | " | 110 | 20.5 | 107 | 20.1 | 91 | 14.0 |
| 2-4 | D | " | 112 | 20.7 | 110 | 20.2 | 93 | 14.3 |
| 2-5 | E | " | 102 | 19.0 | 100 | 18.5 | 83 | 11.8 |
| 2-6 | F | " | 105 | 18.0 | 100 | 17.0 | 78 | 7.6 |
| 2-7 | G | " | 155 | 17.0 | 138 | 14.0 | 117 | 7.0 |
| 2-8* | A | D2-2 | 100 | 19.6 | 100 | 19.0 | 95 | 17.0 |
| 2-9* | B | " | 98 | 19.4 | 98 | 19.2 | 93 | 18.0 |
| 2-10* | C | " | 112 | 20.8 | 110 | 20.0 | 107 | 19.6 |
| 2-11* | D | " | 112 | 21.0 | 110 | 20.1 | 107 | 19.8 |
| 2-12* | E | " | 105 | 19.2 | 100 | 18.8 | 95 | 18.0 |
| 2-13 | F | " | 107 | 18.8 | 95 | 17.4 | 89 | 10.6 |
| 2-14 | G | " | 155 | 17.6 | 141 | 16.2 | 126 | 7.9 |

*The present invention

[Back Protective Layer]

| | |
|---|---|
| Gelatin | 0.8 mg/m$^2$ |
| Polymethyl methacrylate fine particle (average particle size: 4.5 μm) | 30 mg/m$^2$ |
| Sodium dihexyl-α-sulfosuccinate | 15 mg/m$^2$ |

TABLE 8

| Composition of Developer | Developer No. and Composition (g) | | | | |
|---|---|---|---|---|---|
| Developer components | D2-1 | D2-2 | D2-3 | D2-4 | D2-5 |
| Potassium hydroxide | 35 | " | " | " | " |
| Diethylene triamine pentaacetate | 2.0 | " | " | " | " |
| Potassium carbonate | 40 | 100 | 85 | 70 | 100 |
| Potassium bromide | 3 | " | " | " | " |
| 5-Methylbenzotriazole | 0.08 | " | " | " | " |
| Sodium 2-mercaptobenz-imidazole-5-sulfonate | 0.15 | " | " | " | " |

TABLE 8-continued

| Composition of Developer | Developer No. and Composition (g) | | | | |
|---|---|---|---|---|---|
| Developer components | D2-1 | D2-2 | D2-3 | D2-4 | D2-5 |
| 2,3,5,6,7,8-Hexahydro-2-thioxo-4-(1H)-xynazoline | 0.03 | " | " | " | " |
| Sodium metabisulfite | 44 | 54 | 62 | 44 | 54 |
| 4-Hydroxymethyl-4-methyl-1-phenyl-3-pyrazolidone | 0.45 | " | " | " | " |
| Hydroquinone | 23.3 | 30.0 | 35.0 | 23.3 | 35.0 |
| Sodium erythorbate | 3.0 | " | " | " | " |
| Water to | 1 l | " | " | " | " |
| pH adjusted to | 10.5 | 10.5 | 10.5 | 10.5 | 10.5 |
| pH increase value when 0.1 mol of NaOH is added to 1 l of the developer | 0.5 | 0.23 | 0.24 | 0.3 | 0.24 |
| Remarks | Comp. | Inv. | Inv. | Comp. | Inv. |

(Photographic properties 2 and 3: Running performances)

The sample produced as described above was used to carry out the running experiments. As for running conditions, taking the continuous running where 40 sheets of 80% blacked films of 20×24 inch paper having a size of 50.8 cm×61.0 cm (8 of 10 sheets were exposed with a light) were processed per day, and this running was conducted for 6 days and suspended for 1 day as 1 round, the running was carried out 6 rounds. The amounts of a developer replenished were set at 250 ml/m$^2$ and 170 ml/m$^2$.

Each of the developers after running was evaluated under the same conditions as in photographic properties, which are designated as photographic properties 2 and 3.

EXAMPLE 2-2

The running test similar to Example 2-1 and a silver staining test were carried out using a combination of samples used in Sample Nos. 2-1, 2-3 and 2-5 in Example 2-1 with Developers D2-1 to D2-5. The results are shown in Table 9. As is clear from Table 9, the combinations of the present invention (Sample Nos. 2-16, 2-17, 2-19, 2-21, 2-22, 2-24, 2-26, 2-27, and 2-29) showed good results.

TABLE 9

| | | | Photographic properties 1 | | Photographic properties 3 | | Silver |
|---|---|---|---|---|---|---|---|
| No. | Emulsion | Developer | Sensitivity | Gradation | Sensitivity | Gradation | staining |
| 2-15 | A2 | D2-1 | 100 | 19.0 | 85 | 12.0 | 2 |
| 2-16* | " | D2-2 | 100 | 19.6 | 94 | 17.0 | 4 |
| 2-17* | " | D2-3 | 98 | 19.8 | 93 | 18.0 | 4 |
| 2-18 | " | D2-4 | 98 | 19.0 | 81 | 11.0 | 2 |
| 2-19* | " | D2-5 | 98 | 19.6 | 91 | 16.0 | 4 |
| 2-20 | C2 | D2-1 | 110 | 20.5 | 89 | 14.0 | 2 |
| 2-21* | " | D2-2 | 110 | 20.8 | 105 | 18.8 | 4 |
| 2-22* | " | D2-3 | 107 | 21.0 | 100 | 19.6 | 4 |
| 2-23 | " | D2-4 | 107 | 20.2 | 85 | 13.9 | 2 |
| 2-24* | " | D2-5 | 107 | 20.8 | 95 | 17.0 | 4 |
| 2-25 | E2 | D2-1 | 102 | 19.0 | 87 | 11.0 | 2 |
| 2-26* | " | D2-2 | 105 | 19.2 | 97 | 17.2 | 4 |
| 2-27* | " | D2-3 | 100 | 19.0 | 93 | 17.0 | 4 |
| 2-28 | " | D2-4 | 98 | 19.0 | 85 | 11.6 | 2 |
| 2-29* | " | D2-5 | 100 | 19.1 | 93 | 16.2 | 4 |

The silver staining was visually evaluated at 5-point ranks.

The rank "5" represents that no silver staining occurs on the film, the developing tank and the roller. The rank "1" represents that silver staining occurs on the whole surface of the film, and a large amount of silver staining occurs the developing tank, and the roller. The rank "4" represents that no silver staining occurs on the film but a small amount of silver staining occurs on the developing tank and the roller and is a practically allowable level. The rank "3" or less is a bad level having practical problems.

EXAMPLE 2-3

When the combination of hydrazine compounds I-10 and I-29 and the combination of hydrazine compounds I-33 and I-24 were used in place of hydrazine compound derivatives in Example 2-2, the constructions of the present invention gave good results.

EXAMPLES 3-1 TO 3-3

[Emulsion A3]

Into an aqueous gelatine solution kept at 40° C. were simultaneously added an aqueous silver nitrate solution and an aqueous sodium chloride solution containing $5\times10^{-5}$ mol of $(NH_4)_2Rh(H_2O)Cl_5$ per mol of silver over a period of 3 minutes. By controlling the electric potential in this course to 95 mV, particles of the core portion having the particle size of 0.08 μm was prepared. Thereafter, an aqueous silver nitrate solution and an aqueous sodium chloride solution containing $1.5\times10^{-4}$ mol of $(NH_4)_2Rh(H_2O)Cl_5$ per mol of silver were simultaneously added over a period of 6 minutes. By controlling the electric potential in this course to 100 mV, silver chloride cubic particles having an average particle size of 0.15 μm and a total $(NH_4)_2Rh(H_2O)Cl_5$ content of $5\times10^{-5}$ mol/mol Ag was prepared. As a stabilizer, $1\times10^{-3}$ mol/mol Ag of 6-hydroxy-4-methyl-1,3,3a,7-tetrazaindene was added, the emulsion was washed by a flocculation method, and then gelatine was added.

Emulsions [B3] to [H3] as shown in Table 10 were prepared in a similar manner.

TABLE 10

| Emulsion No. | Silver halide emulsion: Composition of halogen | Silver halide emulsion: Particle size (μm) | Rhodium or ruthenium compound: Type | Rhodium or ruthenium compound: Amount (mol/mol Ag) | Dispersion coefficient (%) | Crystal type |
|---|---|---|---|---|---|---|
| A3 | $AgCl_{100}$ | 0.15 | $(NH_4)_2Rh(H_2O)Cl_5$ | $5\times10^{-5}$ | 12 | Cube |
| B3 | $AgBr_5Cl_{95}$ | 0.15 | " | " | 11 | " |
| C3 | $AgCl_{100}$ | 0.15 | $K_4Ru(NO)Cl_5$ | " | 10 | " |
| D3 | $AgCl_{100}$ | 0.10 | $(NH_4)_2Rh(H_2O)Cl_5$ | $8\times10^{-5}$ | 11 | " |
| E3 | $AgCl_{100}$ | 0.18 | $(NH_4)_2Rh(H_2O)Cl_5$ | $5\times10^{-5}$ | 10 | " |
| F3 | $AgBr_5Cl_{95}$ | 0.10 | $K_2Ru(NO)Cl_5$ | " | 12 | " |
| G3 | $AgCl_{100}$ | 0.22 | $(NH_4)_2Rh(H_2O)Cl_5$ | " | 11 | " |
| H3 | $AgBr_{15}Cl_{85}$ | 0.15 | " | " | 13 | " |

EXAMPLE 3-1

To above-described emulsions [A3] to [H3] were added hydrazine compounds (I-33) ($1\times10^{-4}$ mol/mol Ag) and I-41 ($1\times10^{-4}$ mol/mol Ag), and the following compound (a) ($1\times10^{-4}$ mol/mol Ag) and the following compound (b) ($3\times10^{-4}$ mol/mol Ag) were added thereto as nucleating accelerators.

Thereafter, $2\times10^{-4}$ mol of 1-phenyl-5-mercaptotetrazole per mol of silver and polyacrylate latex in a solid form in an amount of 30 wt % based on gelatine were added thereto as hardeners, and applied on a vinylidene chloride primer-coated polyethylene terephthalate film in such an amount that the amount of Ag was 3.8 g/m². On this layer, an upper protective layer, a lower protective layer, a backing layer, and a back protective layer each having the following formulation were placed to prepare a sample.

Nucleating accelerator (a)

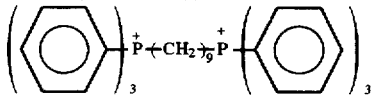

10 mg/m²

Nucleating accelerator (b)

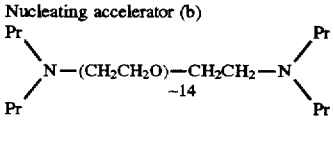

10 mg/m²

[Lower protective layer]

| | |
|---|---|
| Gelatine | 1 g/m² |
| Thioctic acid | 6 mg/m² |
| Sodium ethylthiosulfonate | 4 mg/m² |
| Solid dyestuff ($a_3$) | 100 mg/m² |

-continued

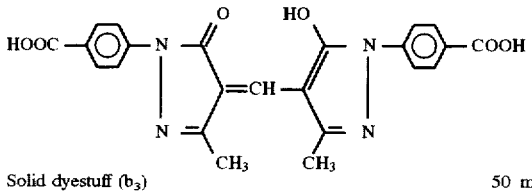

Solid dyestuff ($b_3$) 50 mg/m²

-continued

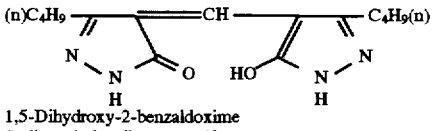

| | |
|---|---|
| 1,5-Dihydroxy-2-benzaldoxime | 35 mg/m² |
| Sodium dodecylbenzenesulfonate | 10 mg/m² |
| Sodium polystyrenesulfonic acid | 20 mg/m² |
| Ethyl acrylate latex (average particle size: 0.05 μm) | 0.2 g/m² |

[Upper protective layer]

| | |
|---|---|
| Gelatine | 0.6 g/m² |
| Fine polymethyl methacrylate particle (average particle size: 3.5 μm) | 20 mg/m² |
| Fine silicone dioxide particle (average particle size: 3.8 μm) | 30 mg/m² |
| Potassium salt of N-perfluoro-octanesulfonyl-N-propylene glycine | 3 mg/m² |
| Sodium dodecylbenzenesulfonate | 20 mg/m² |

[Backing layer]

| | |
|---|---|
| Gelatine | 2.5 g/m² |
| Dyestuff ($c_3$) | 0.26 g/m² |

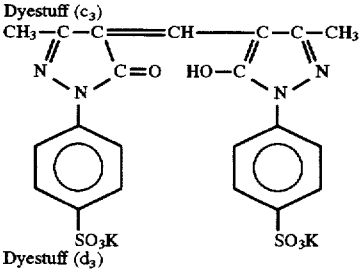

Dyestuff ($d_3$) 30 mg/m²

-continued

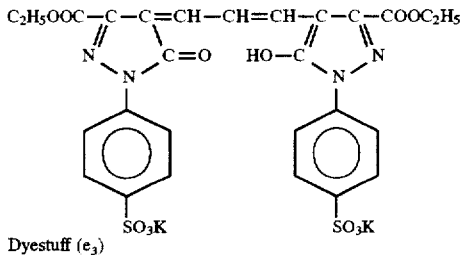

Dyestuff ($e_3$) 40 mg/m²

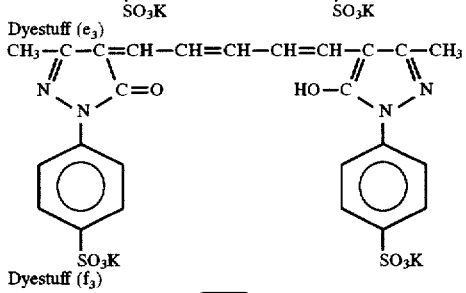

Dyestuff ($f_3$) 90 mg/m²

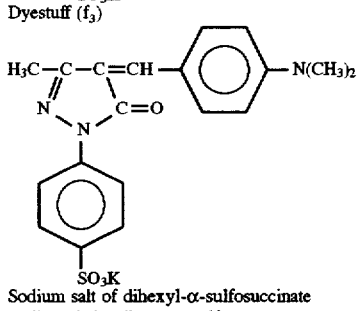

| | |
|---|---|
| Sodium salt of dihexyl-α-sulfosuccinate | 30 mg/m² |
| Sodium dodecylbenzenesulfonate | 35 mg/m² |
| 1,3-Divinylsulfonyl-2-propanolethyl acrylate latex (average particle size: 0.05 μm) | 130 mg/m² |
| Electric conductive compound $SnO_2$/Sb (weight ratio: 9/1, particle size: 0.2 μm) | 0.5 g/m² |

[Back protective layer]

| | |
|---|---|
| Gelatine | 0.8 g/m² |
| Fine polymethyl methacrylate particle (average particle size: 3.4 μm) | 40 mg/m² |
| Sodium salt of dihexyl-α-sulfosuccinate | 15 mg/m² |
| Sodium dodecylbenzenesulfonate | 15 mg/m² |
| Fluorine surfactant | 5 mg/m² |
| $C_8F_{17}SO_2NHC_2COOK$ \| $C_3H_7$ | |
| Sodium acetate | 40 mg/m² |

Evaluations of the quality of the superimposed letter image and running suitability were carried out in the following methods.

[Quality of the superimposed letter image]

As described in JP-A-58-190943, a film on which a pasting base/line original positive image had been formed (line original text) and a film on which a pasting base/halftone image had been formed (halftone text) were piled and brought in contact with each of the samples in such a manner that the protective layer of the sample and the halftone text were placed face to face, and subjected to exposure suitable for 50% halftone transferring 50% halftone area on the film sample. When being processed as described above, a sample which could reproduce a 30 μm wide letter of the line original text was designated as 5, and a sample which could only reproduce a 150 μm wide letter of the line original text was designated as 1. Between 5 and 1, ranks 4, 3, and 2 were provided by a panel evaluation. The rank 2 is a critical for practical application.

[Evaluations of Running suitability 1 and 2]

Taking the continuous running where 50 sheets of samples (20×24 inch paper having a size of 50.8 cm×61.0 cm) using 50% blacked emulsions A to H were processed per day, and this running was conducted for 6 days and suspended for 1 day as 1 round, the running was carried out 6 rounds. The change of halftone % when being developed with the developer after 6 rounds running relative to a corresponding fresh developer (evaluating the point where 50% of the original halftone was reversed 50% using a fresh developer) and the superimposed letter were evaluated. The amounts of a developer replenished were set at 250 ml/m² and 180 ml/m², which were running suitability 1 and 2, respectively.

[Developing conditions]

With regard to the developing conditions, the processing was carried out with developers (D2-1 and D2-2) each having the composition as shown in Table 2 using FG-680AG (produced by Fuji Photo Film Co., Ltd.) at 38° C. for 20 seconds. The fixer used was GR-F1.

TABLE 11

Composition of Developer

| | Developer No. and Composition (g) | | | | |
|---|---|---|---|---|---|
| Developer components | D3-1 | D3-2 | D3-3 | D3-4 | D3-5 |
| Potassium hydroxide | 35 | " | " | " | " |
| Diethylene triamine pentaacetate | 2.0 | " | " | " | " |
| Potassium carbonate | 40 | 100 | 85 | 70 | 85 |
| Potassium broimide | 3 | " | " | " | " |
| 5-Methylbenzotriazole | 0.08 | " | " | " | " |
| Sodium 2-mercaptobenzimidazole-5-sulfonate | 0.15 | " | " | " | " |
| 2,3,5,6,7,8-Hexahydro-2-thioxo-4-(1H)-xynazoline) | 0.03 | " | " | " | " |
| Sodium metabisulfite | 44 | 54 | 62 | 44 | 62 |
| 4-Hydroxymethyl-4-methyl-1-phenyl-3-pyrazolidone | 0.45 | " | " | " | " |
| Hydroquinone | 23.3 | 30.0 | 35.0 | 23.3 | 35.0 |
| Sodium erythorbate | 3.0 | " | " | " | " |
| Water to | 1 l | " | " | " | " |
| pH adjusted to | 10.5 | 10.5 | 10.5 | 10.5 | 10.5 |
| pH increase value when 0.1 mol of NaOH is addedto 1 l of the developer | 0.5 | 0.23 | 0.24 | 0.3 | 0.24 |
| Remarks | Comp. | Inv. | Inv. | Comp. | Inv. |

The test results are shown in Table 12. As is clear from Table 12, the construction of the present invention was less changes of superimposed letter and halftone%, and exhibits good performances even under the conditions of a small amount of a developer replenished (Running suitability 2), and exhibited good performances.

TABLE 12

| No. | Emulsion | Developer | Super-imposed letter of fresh liquid | Running test (1) Super-imposed letter | Δ % | Running test (2) Super-imposed letter | Δ % |
|---|---|---|---|---|---|---|---|
| 3-1 | A3 | D3-1 | 5 | 5 | ±0 | 2 | −3 |
| 3-2 | B3 | " | 5 | 5 | ±0 | 2 | −3 |
| 3-3 | C3 | " | 5 | 5 | ±0 | 2 | −3 |
| 3-4 | D3 | " | 5 | 5 | ±0 | 2 | −3 |
| 3-5 | E3 | " | 5 | 5 | ±0 | 2 | −3 |
| 3-6 | F3 | " | 5 | 5 | ±0 | 2 | −3 |
| 3-7 | G3 | " | 4 | 4 | −1 | 1 | −4 |
| 3-8 | H3 | " | 4 | 4 | −1 | 1 | −4 |
| 3-9* | A3 | D3-2 | 5 | 5 | ±0 | 5 | ±0 |
| 3-10* | B3 | " | 5 | 5 | ±0 | 4 | −0.5 |
| 3-11* | C3 | " | 5 | 5 | ±0 | 5 | ±0 |
| 3-12* | D3 | " | 5 | 5 | ±0 | 5 | ±0 |
| 3-13* | E3 | " | 5 | 5 | ±0 | 4 | −1 |
| 3-14* | F3 | " | 5 | 5 | ±0 | 5 | ±0 |
| 3-15 | G3 | " | 5 | 4 | ±0 | 2 | −3 |
| 3-16 | H3 | " | 5 | 4 | ±0 | 2 | −3 |

*The present invention

EXAMPLE 3-2

The evaluations of Running test 2 were carried out using a combination of samples used in Sample Nos. 3-1 to 3-5 in Example 3-1 with Developers D3-1 to D3-5.

Silver staining was visually evaluated at 5-point ranks.

The rank "5" represents no silver staining occurs on the film, the developing tank, and the roller. The rank "1" represents that silver staining occurs on the whole surface of the film, and a large amount of silver staining occurs the developing tank, and the roller. The rank "4" represents that no silver staining occurs on the film but a small amount of silver staining occurs on the developing tank and the roller and is a practically allowable level. The rank "3" or less is a bad level having practical problems.

The results are shown in Table 13. As is clear from Table 13, Sample Nos. 3-18, 3-19, 3-21, 3-23, 3-24, 3-26, 3-28, 3-29, and 3-31, which have the constructions of the present invention have stable running performances and less silver staining. Of the developers of the present invention (D3-2, D3-3 and D3-5), Developers D3-2 and D3-3 containing erythorbic acid show more excellent results.

TABLE 13

| No. | Emul-sion | Deve-loper | Super-imposed letter of fresh liquid | Running test (2) Super-imposed letter | Δ% | Ag staining |
|---|---|---|---|---|---|---|
| 3-17 | A3 | D3-1 | 5 | 2 | −3 | 2 |
| 3-18* | " | D3-2 | 5 | 5 | ±0 | 4 |
| 3-19* | " | D3-3 | 5 | 5 | ±0 | 4 |
| 3-20 | " | D3-4 | 5 | 2 | −3 | 2 |
| 3-21* | " | D3-5 | 5 | 4 | −1 | 4 |
| 3-22 | C3 | D3-1 | 5 | 2 | −3 | 2 |
| 3-23* | " | D3-2 | 5 | 5 | ±0 | 4 |
| 3-24* | " | D3-3 | 5 | 5 | ±0 | 4 |
| 3-25 | " | D3-4 | 5 | 2 | −3 | 2 |
| 3-26* | " | D3-5 | 5 | 4 | −1 | 4 |
| 3-27 | E3 | D3-1 | 5 | 2 | −4 | 3 |
| 3-28* | " | D3-2 | 5 | 5 | −0.5 | 5 |
| 3-29* | " | D3-3 | 5 | 5 | −0.5 | 5 |

TABLE 13-continued

| No. | Emul-sion | Deve-loper | Super-imposed letter of fresh liquid | Running test (2) Super-imposed letter | Δ% | Ag staining |
|---|---|---|---|---|---|---|
| 3-30 | " | D3-4 | 5 | 1 | −3 | 3 |
| 3-31* | " | D3-5 | 5 | 4 | −1 | 5 |
| 3-32 | G3 | D3-1 | 4 | 1 | −4 | 4 |
| 3-33 | " | D3-2 | 4 | 2 | −3 | 5 |
| 3-34 | " | D3-3 | 5 | 2 | −3 | 5 |
| 3-35 | " | D3-5 | 4 | 1 | −4 | 4 |
| 3-36 | " | D3-6 | 4 | 1 | −4 | 5 |

*The present invention

EXAMPLE 3-3

When the combination of hydrazine compounds I-30 and I-45 and the combination of hydrazine compounds I-12 and I-29 were used in place of hydrazine compounds I-33 and 1-41 in Example 3-1, similar results are obtained.

While the invention has been described in detail and with reference to specific examples thereof, it will be apparent to one skilled in the art that various changes and modifications can be made therein without departing from the spirit and scope thereof.

What is claimed is:

1. A development processing method, which comprises the steps of (a) exposing a black and white silver halide photographic material comprising a support having thereon at least one light-sensitive silver halide emulsion layer and (b) developing the exposed silver halide photographic material with a developer while the developer is concurrently replenished with a development replenisher, wherein the developer and the development replenisher each contains a dihydroxybenzene developing agent and an auxiliary developing agent exhibiting a super-additive property to the dihydroxybenzene developing agent, and both the developer and the development replenisher have such a property that an increase of the pH is 0.25 or less when 0.1 mol of sodium hydroxide is added to 1 liter thereof;

the developer has a pH from 9.5 up to but excluding 11.0; and the developer replenisher is added in an amount of 225 $ml/m^2$ or less;

wherein the silver halide photographic material can further comprise at least one other hydrophilic colloid layer in addition to the at least one light-sensitive silver halide emulsion layer on a support, wherein a silver halide emulsion layer or another hydrophilic colloid layer contains at least one hydrazine derivative represented by the following formula (I):

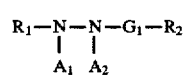

$$R_1-\underset{\underset{A_1}{|}}{N}-\underset{\underset{A_2}{|}}{N}-G_1-R_2 \quad (I)$$

wherein $R_1$ represents an aliphatic group or an aromatic group;

$R_2$ represents a hydrogen atom, an alkyl group, an aryl group, an unsaturated heterocyclic group, an alkoxy group, an aryloxy group, an amino group or a hydrazino group;

$G_1$ represents —CO—, —$SO_2$—, —SO—, —PO($R_3$)—, —CO—CO—, a thiocarbonyl group or an iminomethylene group, in which $R_3$ has the same meaning as $R_2$, but it may be different from $R_2$;

$A_1$ and $A_2$ are both a hydrogen atom, or one of them is a hydrogen atom and the other is an alkylsulfonyl group, an arylsulfonyl group or an acyl group; and wherein a black and white image having a gamma value of 10 or more is obtained.

2. The method as claimed in claim 1, wherein the developer replenisher is added in an amount of 50 to 180 ml/$m^2$.

3. The method as claimed in claim 1, wherein the developer is prepared by using a solid processing agent.

4. The method as claimed in claim 1, wherein at least one compound selected from compounds represented by the following formula (II), (III), (IV) or (V) and an amine compound acting as an incorporated nucleating accelerator is contained in the photographic material:

(II)

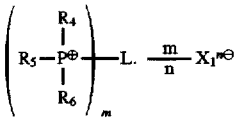

wherein $R_4$, $R_5$ and $R_6$ each independently represents an alkyl group, a cycloalkyl group, an aryl group, an alkenyl group, a cycloalkenyl group or a heterocyclic group;

m represents an integer of from 1 to 4;

L represents an m-valent organic group which bonds to the P atom in formula (II) via a carbon atom;

n represents an integer of from 1 to 3; and $X_1$ represents an n-valent anion and $X_1$ may be connected to L;

(III)

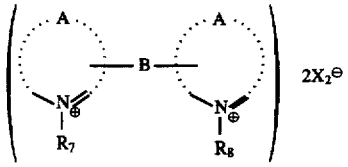

(IV)

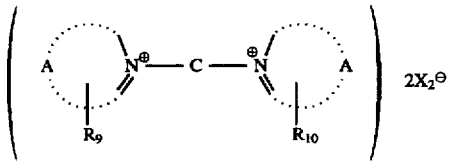

wherein A represents an organic group necessary for forming a heterocyclic ring;

B and C each independently represents a divalent group;

$R_7$ and $R_8$ each independently represents an alkyl group or an aryl group;

$R_9$ and $R_{10}$ each independently represents a hydrogen atom or a substituent; and $X_2$ represents an anion, with the proviso that, if an intermolecular salt is formed, $X_2$ does not exist;

(V)

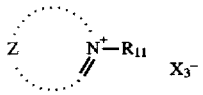

wherein Z represents an atomic group necessary for forming a nitrogen-containing heteroaromatic ring;

$R_{11}$ represents an alkyl group; and $X_3^-$ represents a counter anion.

5. The method as claimed in claim 1, wherein the silver halide emulsion has a silver chloride content of 50 mol % or more and contains at least one complex selected from a rhodium complex, a ruthenium complex, a rhenium complex and an osmium complex in an amount of from $1\times10^{-8}$ to $1\times10^{-6}$ per mol of silver.

6. The method as claimed in claim 1, wherein the silver halide emulsion has an average particle size of less than 0.2 μm and a silver chloride content of 90 mol % or more.

7. The method as claimed in claim 1, wherein the silver halide emulsion contains a rhodium complex or a ruthenium complex in an amount of from $1\times10^{-6}$ to $5\times10^{-4}$ mol per mol of silver.

8. The method as claimed in claim 1, wherein the at least one light-sensitive silver halide emulsion contains a silver halide particle which is sensitized with a selenium sensitizer or a tellurium sensitizer.

9. The method as claimed in claim 1, wherein the developer contains a salt of carbonic acid in an amount of 0.5 mol/l or more.

10. The method as claimed in claim 1, wherein the dihydroxybenzene developing agent is used in an amount of 0.23 mol/l or more.

11. The method as claimed in claim 1, wherein the auxiliary developing agent exhibiting a superadditive property is at least one of a 1-phenyl-3-pyrazolidone compound and a p-aminophenol compound.

12. The method as claimed in claim 1, wherein the developer contains a free sulfite ion and an ascorbic acid derivative each in an amount of from 0.3 to 1.2 mol/l, and the concentration ratio of the ascorbic acid derivative to the dihydroxybenzene developing agent is from 0.03/1 to 12/1 by mol.

13. The method as claimed in claim 3, wherein the solid processing agent contains at least two mutually reactive granular substances;

the two mutually reactive granular substances are separated by at least one separation layer containing an inert substance to the two mutually reactive substances;

a bag which can be vacuum-packed is used as a coating material;

the air in the bag is exhausted; and the exhausted bag is sealed.

* * * * *